US008738170B2

(12) United States Patent
Kato et al.

(10) Patent No.: US 8,738,170 B2
(45) Date of Patent: May 27, 2014

(54) SEWING MACHINE AND AN EMBROIDERY FRAME

(71) Applicants: Harumi Kato, Nagoya (JP); Katsuhisa Hasegawa, Kasugai (JP); Midori Magara, Nagoya (JP)

(72) Inventors: Harumi Kato, Nagoya (JP); Katsuhisa Hasegawa, Kasugai (JP); Midori Magara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/623,542

(22) Filed: Sep. 20, 2012

(65) Prior Publication Data

US 2013/0074748 A1 Mar. 28, 2013

(30) Foreign Application Priority Data

Sep. 28, 2011 (JP) ..... 2011-213124

(51) Int. Cl.
*D05C 5/02* (2006.01)

(52) U.S. Cl.
USPC ..... 700/138; 112/102.5; 112/103

(58) Field of Classification Search
USPC ..... 700/136–138; 112/102, 102.5, 103, 112/118, 119
See application file for complete search history.

(56) References Cited

U.S. PATENT DOCUMENTS 674,014 A * 5/1901 Parkes ..... 112/103
1,120,357 A 12/1914 Austin
2,989,015 A 6/1961 Taketomi
4,247,998 A 2/1981 Foss
4,411,208 A 10/1983 Nishida et al.
4,422,250 A 12/1983 Golan
4,598,655 A 7/1986 Takenoya
4,762,076 A * 8/1988 Wakaizumi ..... 112/103
4,774,778 A 10/1988 Williams
4,849,902 A * 7/1989 Yokoe et al. ..... 112/470.04
4,943,906 A * 7/1990 Tajima et al. ..... 700/83
4,998,489 A * 3/1991 Hisatake et al. ..... 112/103
5,144,899 A 9/1992 Allen
5,151,863 A * 9/1992 Komuro et al. ..... 700/138

(Continued)

FOREIGN PATENT DOCUMENTS

JP A 59-181185 10/1984
JP A 03-193090 8/1991

(Continued)

OTHER PUBLICATIONS

U.S. Appl. No. 13/624,420, filed Sep. 21, 2012.

(Continued)

*Primary Examiner* — Danny Worrell
(74) *Attorney, Agent, or Firm* — Oliif PLC

(57) ABSTRACT

A sewing machine includes a mounting adaptor, a memory, an imager, and a processor. The mounting adaptor may be mounted with an embroidery frame. The memory may store frame rotation data. The frame rotation data indicate a setting angle which is a predetermined rotation angle of the frame with respect to the outer frame. The imager may image an area including the embroidery frame mounted on the mounting adaptor. The processor may control the sewing machine to detect a marker provided on at least one of the embroidery frame and the work cloth based on the image, determine a rotation angle of the frame with respect to the outer frame based on the detected marker, and control the driver to adjust a rotation of the frame based on the determined rotation angle and the frame rotation data.

12 Claims, 19 Drawing Sheets

(56) References Cited

U.S. PATENT DOCUMENTS

| | | | | |
|---|---|---|---|---|
| 5,191,536 | A * | 3/1993 | Komuro et al. | 700/138 |
| 5,222,314 | A | 6/1993 | Inteso | |
| 5,261,341 | A * | 11/1993 | Asano | 112/102.5 |
| 5,377,605 | A * | 1/1995 | Frye | 112/114 |
| 5,427,043 | A * | 6/1995 | Conley et al. | 112/102.5 |
| 5,555,828 | A * | 9/1996 | Rowley | 112/103 |
| 5,632,214 | A * | 5/1997 | Conley et al. | 112/470.06 |
| 5,860,374 | A * | 1/1999 | Jensen et al. | 112/102.5 |
| 5,911,182 | A * | 6/1999 | Uyama et al. | 112/102.5 |
| 5,970,895 | A | 10/1999 | Mack | |
| 6,000,350 | A * | 12/1999 | Koike et al. | 112/102.5 |
| 6,095,068 | A * | 8/2000 | Hori | 112/103 |
| 6,119,611 | A * | 9/2000 | Tomita | 112/470.04 |
| 6,167,822 | B1 * | 1/2001 | Miyasako et al. | 112/102.5 |
| 6,298,800 | B1 * | 10/2001 | Gala | 112/103 |
| 7,168,378 | B2 * | 1/2007 | Fukao | 112/103 |
| 7,302,308 | B2 * | 11/2007 | Kato et al. | 700/138 |
| 7,359,760 | B2 * | 4/2008 | Kishi et al. | 700/138 |
| 7,542,822 | B2 * | 6/2009 | Kawaguchi et al. | 700/138 |
| 7,561,939 | B2 * | 7/2009 | Kawabe et al. | 700/138 |
| 8,301,292 | B2 * | 10/2012 | Tokura | 700/138 |
| 8,438,984 | B2 * | 5/2013 | Hasegawa et al. | 112/103 |
| 2005/0234585 | A1 * | 10/2005 | Muto et al. | 700/138 |
| 2006/0167581 | A1 * | 7/2006 | Kawaguchi et al. | 700/138 |
| 2007/0225855 | A1 * | 9/2007 | Yamada | 700/138 |
| 2008/0216721 | A1 * | 9/2008 | Nagai et al. | 112/102.5 |
| 2009/0188413 | A1 * | 7/2009 | Hirata et al. | 112/103 |
| 2009/0188414 | A1 * | 7/2009 | Tokura | 112/457 |
| 2010/0050915 | A1 | 3/2010 | Konig et al. | |

FOREIGN PATENT DOCUMENTS

| | | |
|---|---|---|
| JP | A 05-123464 | 5/1993 |
| JP | U 06-004094 | 1/1994 |
| JP | A-09-217261 | 8/1997 |
| JP | A 2002-136784 | 5/2002 |
| WO | WO 98/24962 A1 | 6/1998 |

OTHER PUBLICATIONS

U.S. Appl. No. 13/624,336, filed Sep. 21, 2012.
U.S. Appl. No. 13/624,350, filed Sep. 20, 2012.
U.S. Appl. No. 13/758,205, filed Feb. 4, 2013 in the name of Harumi Kato.
Dec. 19, 2012 Office Action issued in U.S. Appl. No. 13/624,336.
U.S. Appl. No. 13/624,350, filed Sep. 21, 2012.
Aug. 30, 2013 Office Action issued in U.S. Appl. No. 13/624,350.
Sep. 13, 2013 Office Action issued in U.S. Appl. No. 13/624,420.

* cited by examiner

FIG. 12

59

| VARIABLE N | FRAME ROTATION DATA | X COORDINATE | Y COORDINATE |
|---|---|---|---|
| 1 | -45° | x1 | y1 |
| 2 | -45° | x2 | y2 |
| ⋮ | ⋮ | ⋮ | ⋮ |
| 36 | -45° | x36 | y36 |
| 37 | 0° | x37 | y37 |
| 38 | 0° | x38 | y38 |
| ⋮ | ⋮ | ⋮ | ⋮ |
| 221 | +45° | x221 | y221 |

TAMBOUR WILL BE ROTATED
TARGET ROTATION ANGLE: 0°
CURRENT ROTATION ANGLE: + 45°

FIG. 16

591

| VARIABLE N | FRAME ROTATION DATA | X' COORDINATE | Y' COORDINATE |
|---|---|---|---|
| 1 | 0° | u1 | v1 |
| 2 | 0° | u2 | v2 |
| ⋮ | ⋮ | ⋮ | ⋮ |
| 36 | 0° | u36 | v36 |
| 37 | +45° | u37 | v37 |
| 38 | +45° | u38 | v38 |
| ⋮ | ⋮ | ⋮ | ⋮ |
| 221 | +90° | u221 | v221 |

TAMBOUR WILL BE ROTATED
TARGET ROTATION ANGLE: 0°
CURRENT ROTATION ANGLE: 0°
ROTATION ANGLE MATCHES
TARGET ROTATION ANGLE

SEWING MACHINE AND AN EMBROIDERY FRAME

CROSS-REFERENCE TO RELATED APPLICATION

This application claims priority to Japanese Patent Application No. 2011-213124, filed Sep. 28, 2011, the content of which is hereby incorporated herein by reference in its entirety.

BACKGROUND

The disclosure relates to a sewing machine that may be mounted with an embroidery frame, and the embroidery frame that may be mounted on the sewing machine.

Conventionally, sewing machines that include drivers have been known. The drivers include a driver that moves an embroidery frame, which holds a work cloth, to an X-direction and a Y-direction, and a driver that rotates the embroidery frame. For example, a sewing machine includes an X-axis driver and a Y-axis driver. The X-axis driver includes an X-axis motor that move an embroidery frame, which has a circular shape, to the X-direction. The Y-axis driver includes a Y-axis motor that move the embroidery frame to the Y-direction. The embroidery frame, the X-axis driver, and the Y-axis driver are mounted on a circular plate. The circular plate is rotatably supported by a base connected to the sewing machine. The circular plate is rotated by a θ-axis driver that includes a θ-axis motor. A working cloth supported by the embroidery frame is embroidered by moving the embroidery frame to the X-direction as well as rotating the Y-direction and rotating the embroidery frame by each the motors.

SUMMARY

In the sewing machine described above, the X-axis driver and the Y-axis driver are mounted on the circular plate. Thus, a rotation driver that rotates the embroidery frame may increase in size.

Embodiments of the broad principles derived herein provide a sewing machine that may move and rotate an embroidery frame, which supports a working cloth, and the embroidery frame, especially, the sewing machine that can prevent a rotation driver of the embroidery frame from increasing in size.

Embodiments provide a sewing machine that includes a mounting adaptor, a memory, an imager, and a processor. The mounting adaptor may be mounted with an embroidery frame. The memory may store frame rotation data. The frame rotation data indicate a setting angle which is a predetermined rotation angle of the frame with respect to the outer frame. The imager may image an area including the embroidery frame mounted on the mounting adaptor. The processor may control the sewing machine to detect a marker provided on at least one of the embroidery frame and the work cloth based on the image, determine a rotation angle of the frame with respect to the outer frame based on the detected marker, and control the driver to adjust a rotation of the frame based on the determined rotation angle and the frame rotation data.

Embodiments also provide an embroidery frame that includes a frame. The frame may hold a work cloth. The frame may include a frame, an outer frame and a driver. The frame may hold a work cloth. The outer frame may be detachable outside in a radial direction of the frame and rotatably support the frame. The driver may rotate the frame with respect to the outer frame.

BRIEF DESCRIPTION OF THE DRAWINGS

Embodiments will be described below in detail with reference to the accompanying drawings in which:

FIG. 12 is an explanatory figure of a cutwork data table;

FIG. 16 is an explanatory figure of the cutwork data table after correction;

DETAILED DESCRIPTION

Figure 1:
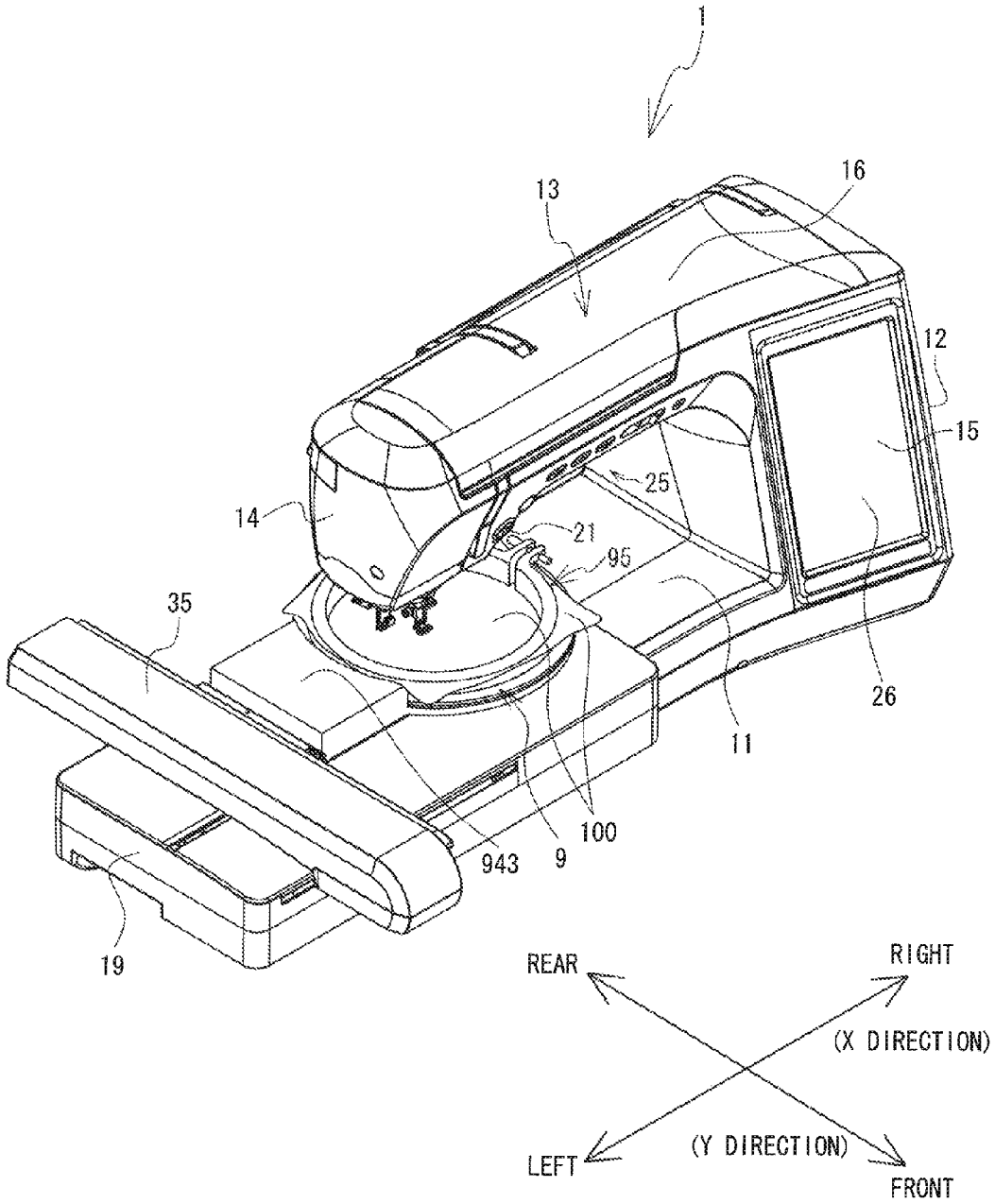
FIG. 1 is an oblique view of a sewing machine on which a embroidery frame is mounted.

Hereinafter, embodiments of the present disclosure will be explained with reference to the drawings. A configuration of a sewing machine 1 will be explained with reference to FIG. 1 and FIG. 3. In FIG. 1, the lower right side, the upper left side, the lower left side and the upper right side respectively correspond to the front side, the rear side, the left side and the right side of the sewing machine 1.

As shown in FIG. 1, the sewing machine 1 is provided with a bed 11, a pillar 12, an arm 13 and a head 14. The bed 11 is a base portion of the sewing machine 1 and extends in the left-right direction. The pillar 12 extends upward from the right end of the bed 11. The arm 13 extends to the left from the upper end of the pillar 12. The head 14 is provided in the left end portion of the arm 13. A needle plate (not shown in the drawings) is provided in the top face of the bed 11. A feed dog (not shown in the drawings), a work cloth feed mechanism (not shown in the drawings), a feed amount adjustment pulse motor 78 (refer to FIG. 11), and a shuttle mechanism (not shown in the drawings) are provided within the bed 11 underneath the needle plate. The feed dog may feed, by a specified feed amount, a work cloth on which sewing is performed. The work cloth feed mechanism may drive the feed dog. The feed amount adjustment pulse motor 78 may adjust the feed amount.

When an operation is performed by the sewing machine 1 to form an embroidery pattern or a cut, a embroidery frame (a embroidery frame 9, for example) that holds the work cloth is placed on the top side of the bed 11. In the sewing machine 1, a sewable area may be set inside the embroidery frame in accordance with a type of the embroidery frame that is mounted on a moving unit 19. The moving unit 19 configured to move the embroidery frame 9 may be removably mounted on the bed 11.

Figure 2:
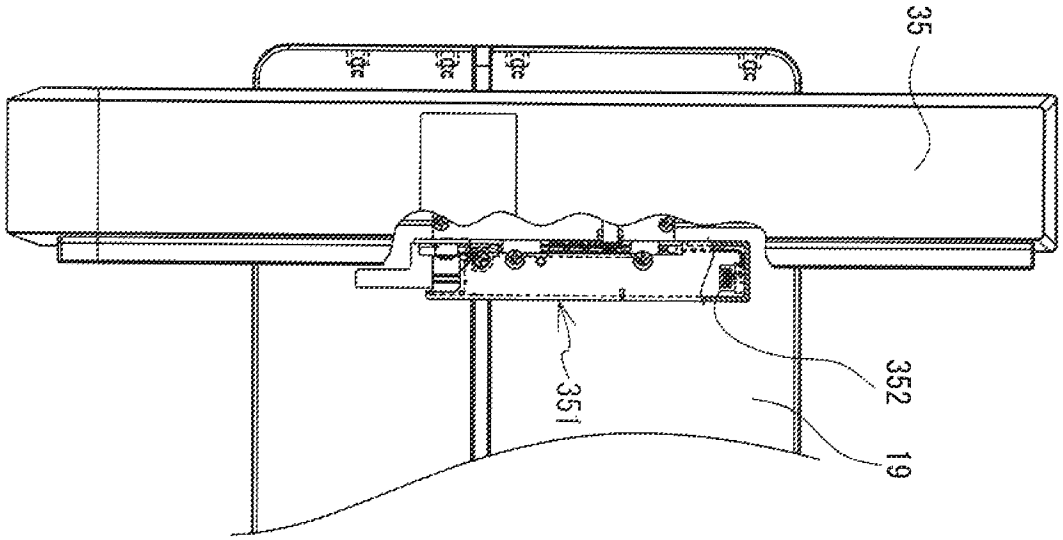
FIG. 2 is a plan view of a mounting adaptor that is provided on a carriage cover.

A carriage cover 35 that extends in the front-rear direction is provided on the upper portion of the moving device 19. A Y axis moving mechanism (not shown in the drawings) is provided inside the carriage cover 35. The Y axis moving mechanism is configured to move a carriage (not shown in the drawings) in a Y direction (the front-rear direction of the sewing machine 1). The embroidery frame 9 is configured to be removably mounted on the carriage. As shown in FIG. 2, a mounting adaptor 351 on which the embroidery frame 9 may be mounted is provided on the right side of the carriage. The mounting adaptor 351 projects to the right from the right side face of the carriage cover 35. The mounting adaptor 351 is long in the front-rear direction such that it corresponds to an attachment portion 942 (refer to FIG. 5) of the embroidery frame 9. The attachment portion 942 (refer to FIG. 5) that is provided on the embroidery frame 9 may be mounted on the mounting adaptor 351 (refer to FIG. 10). As shown in FIG. 2, a sewing machine side connector portion 352 is provided on the rear portion of the mounting adaptor 351. The sewing machine side connector portion 352 is configured to electrically connect to a frame side connector portion 944 (to be described later) that is provided on the embroidery frame 9. The sewing machine side connector portion 352 is a concave connector and is disposed such that a part that connects with the convex frame side connector portion 944 faces toward the front. The carriage, the Y axis moving mechanism, and the carriage cover 35 may be moved in an X direction (the left-right direction of the sewing machine 1) by an X axis moving mechanism (not shown in the drawings). The X axis moving mechanism is provided inside the body of the moving unit 19.

Figure 11:
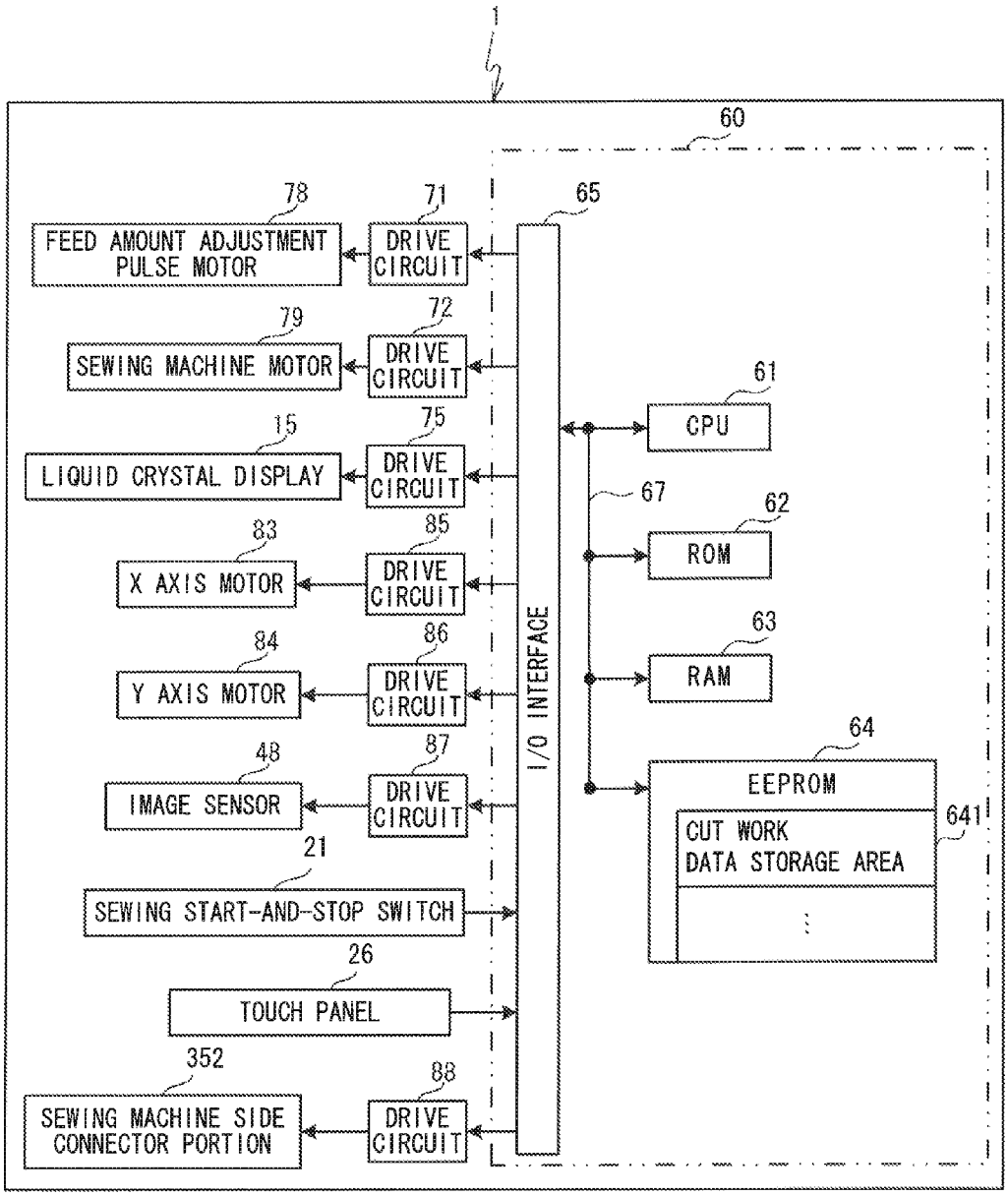
FIG. 11 is a block diagram showing an electrical configuration of the sewing machine.

The X axis moving mechanism and the Y axis moving mechanism may be respectively driven by an X axis motor 83 (refer to FIG. 11) and a Y axis motor 84 (refer to FIG. 11). A needle bar 6 (refer to FIG. 3) and the shuttle mechanism (not shown in the drawings) may be driven as the embroidery frame 9 is moved in the X direction and the Y direction. In this manner, an embroidery sewing operation that sews a specified embroidery pattern in a work cloth 100 that is held by the embroidery frame 9 and an operation that forms cuts in the work cloth 100 in a specified shape may be performed. In a case where an ordinary pattern that is not an embroidery pattern is sewn, the moving unit 19 may be removed from the bed 11, and the work cloth 100 may be placed on the bed 11. Then ordinary sewing may be performed by the driving of the needle bar 6 and the shuttle mechanism as the work cloth 100 is moved by the feed dog.

A vertically long rectangular liquid crystal display 15 is provided on the front face of the pillar 12. Various image items, such as a plurality of types of patterns, names of commands that cause various types of functions to be performed, various types of messages and images that are imaged by an image sensor 48 (refer to FIG. 3), may be displayed on the liquid crystal display 15. A transparent touch panel 26 is provided on the front face of the liquid crystal display 15. By using a finger or a special touch pen to touch a position on the touch panel 26 that corresponds to one of the items that are displayed on the liquid crystal display 15, a user can select a pattern to be sewn or a command to be executed. In the following explanation, an operation performed by the user on the touch panel 26 is referred to as a panel operation.

The structure of the arm 13 will be explained. A cover 16 is provided on the upper portion of the arm 13. The cover 16 is axially supported such that it can be opened and closed by being rotated about an axis that extends in the left-right direction at the upper rear end of the arm 13. A thread container portion (not shown in the drawings) is provided underneath the cover 16, that is, in the interior of the arm 13. The thread container portion may contain a thread spool (not shown in the drawings) that supplies an upper thread. The upper thread that extends from the thread spool may be supplied to a sewing needle 7 (refer to FIG. 3) through a thread hook portion that includes a tensioner, a thread take-up spring, and a thread take-up lever that are not shown in the drawings. The tensioner is provided in the head 14 and configured to adjust the thread tension. The thread take-up lever may be driven reciprocally up and down to pull the upper thread upward. The sewing needle 7 may be attached to the needle bar 6 (refer to FIG. 3). The needle bar 6 may be moved up and down by a needle bar up-and-down moving mechanism (not shown in the drawings) that is provided inside the head 14. The needle bar up-and-down moving mechanism may be driven by a drive shaft (not shown in the drawings) that is rotationally driven by a sewing machine motor 79 (refer to FIG. 11). Namely, the needle bar 6 may be driven by the sewing machine motor 79.

A switch cluster 25 that includes a sewing start/stop switch 21 is provided in the lower portion of the front face of the arm 13. The sewing start/stop switch 21 may be used to start/stop the operation of the sewing machine 1. That is, the sewing start/stop switch 21 may be used by the user to issue commands to start/stop the sewing.

Figure 3:
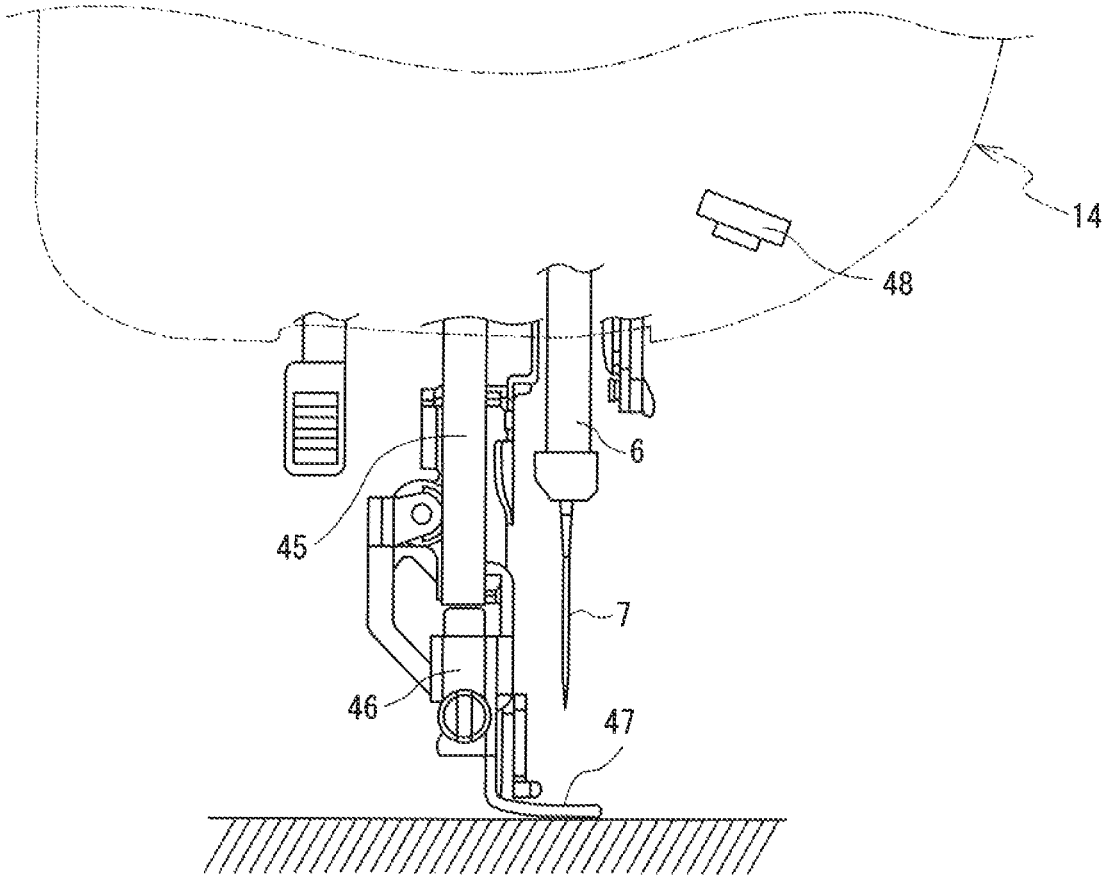
FIG. 3 is a left side view of a needle bar, to which a sewing needle is attached, and an area around the needle bar.

As shown in FIG. 3, the needle bar 6 is provided in the lower portion of the head 14. One of the sewing needle 7 (refer to FIG. 3) and a cutwork needle 8 (refer to FIG. 4) can be attached to the lower end of the needle bar 6. A presser bar 45 is provided to the rear of the needle bar 6. A presser holder 46 is attached to the lower end of the presser bar 45. A presser foot 47 configured to press down on the work cloth 100 may be affixed to the presser holder 46. The image sensor 48 that has a known structure is fixed inside the head 14. The image sensor 48 is configured to image an area including the embroidery frame 9 that is mounted on the mounting adaptor 351.

Figure 4:
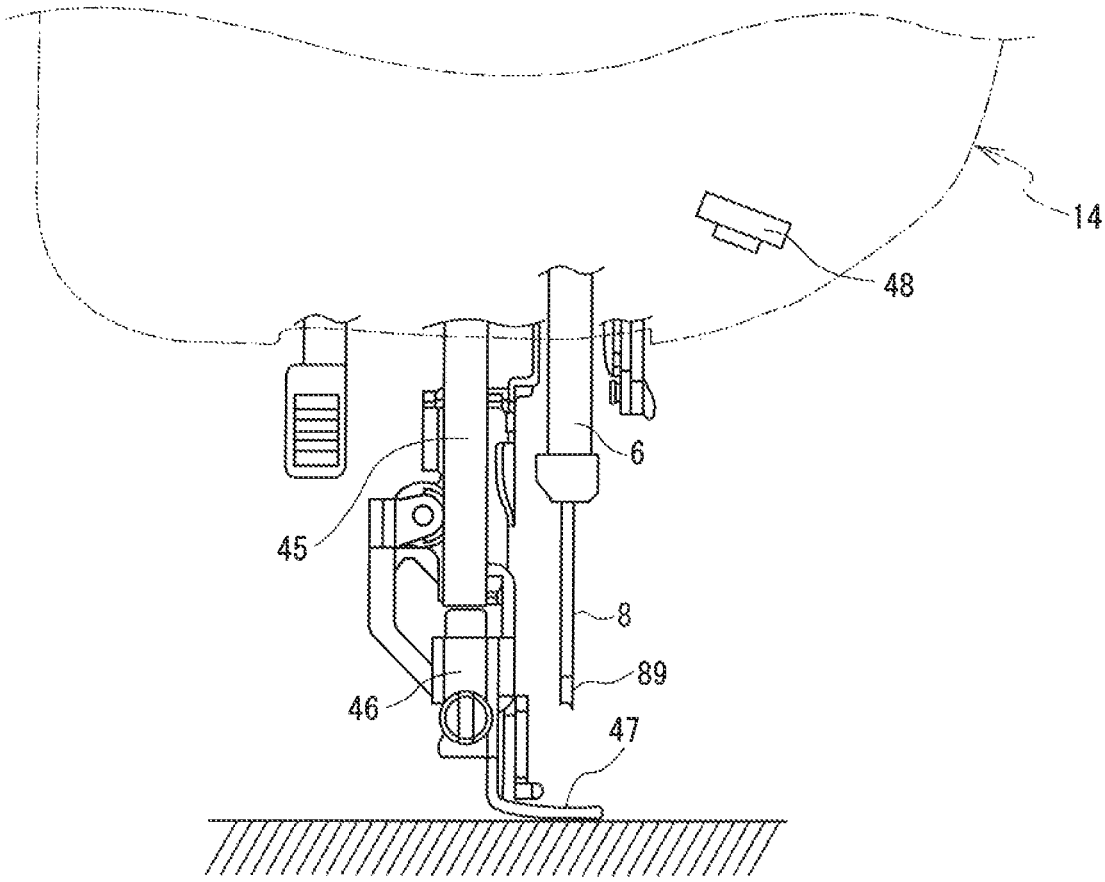
FIG. 4 is a left side view of the needle bar, to which a cutwork needle is attached, and the area around the needle bar.

The cutwork needle 8 will be explained. As shown in FIG. 4, a cutting portion 89 is formed at the tip of the cutwork needle 8. The cutting portion 89 has a sharp-pointed shape in a front view and has a specified width in the front-rear direction (the left-right direction in FIG. 4) in a side view. The lower end of the cutting portion 89 curves obliquely downward from the rear end to the front end. When the needle bar 6 is moved up and down in a state to which the cutwork needle 8 is attached, a cut that extends in the front-rear direction is formed in the work cloth 100. The length of the cut is the same as the width of the cutting portion 89 of the cutwork needle 8. When the cutwork needle 8 is fixed to the lower end of the needle bar 6 in this manner, the sewing machine 1 can form cuts in the work cloth 100. As shown in FIG. 3, the sewing machine 1 can sew embroidery patterns and ordinary patterns when the sewing needle 7 is fixed to the lower end of the needle bar 6.

Figure 5:
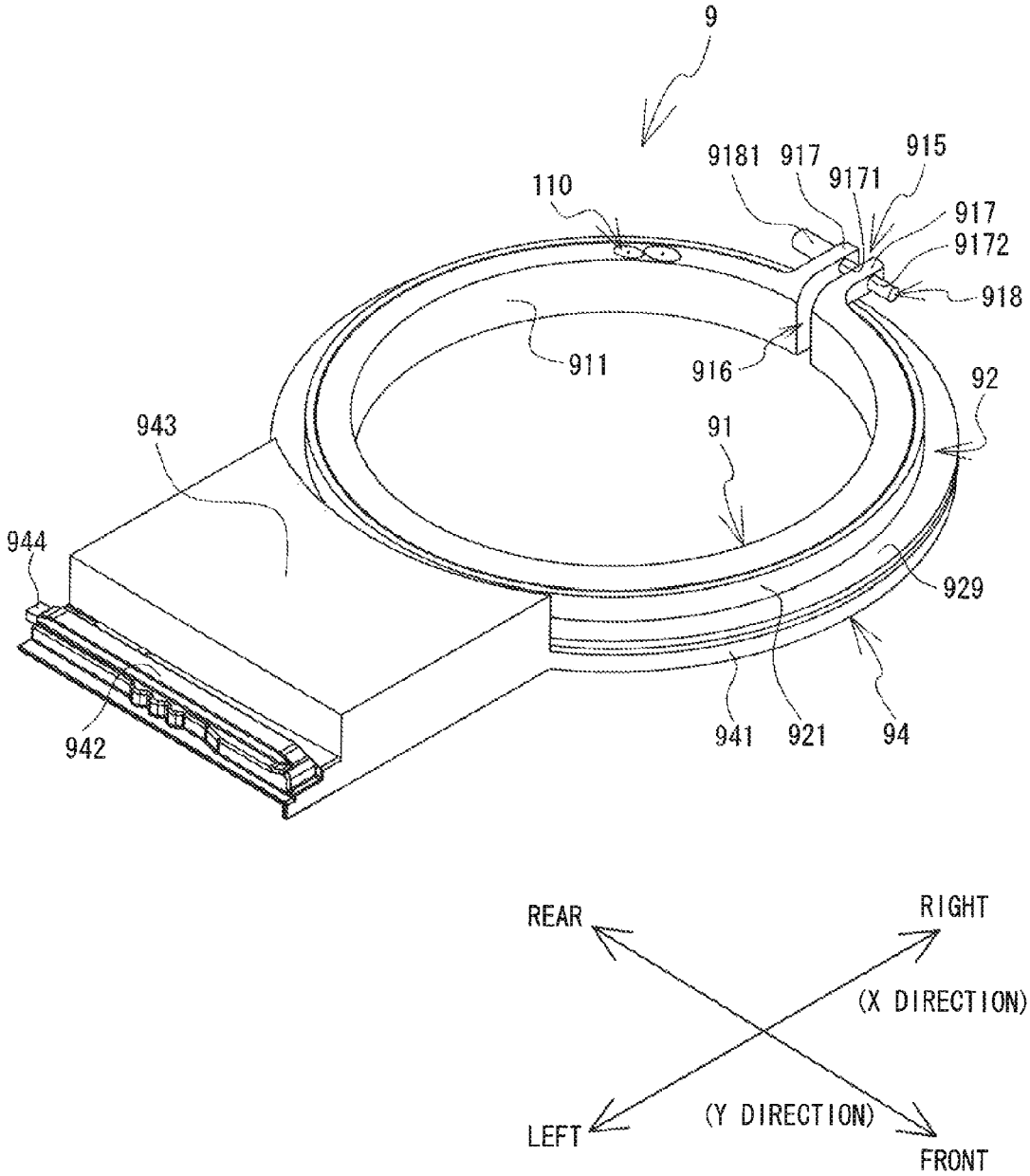
FIG. 5 is an oblique view of the embroidery frame.

The embroidery frame 9 will be explained with reference to FIG. 5 to FIG. 10. In the explanation that follows, the up-down direction in FIG. 5 and FIG. 6 correspond to the up-down direction of the embroidery frame 9. As shown in FIG. 5 to FIG. 10, the embroidery frame 9 is formed by combining an inner frame 91, a middle frame 92, and an outer frame 94, each of which has a circular frame shape. As shown in FIG. 5, the embroidery frame 9 is formed by disposing the middle frame 92 to the outside of the inner frame 91 in the radial direction, and by disposing the outer frame 94 to the outside of the middle frame 92 in the radial direction. The embroidery frame 9 is configured to clamp the work cloth 100 between the inner frame 91 and the middle frame 92. The middle frame 92 is configured to be rotated with respect to the outer frame 94. The inner frame 91 and the middle frame 92 can be rotated with respect to the outer frame 94 around a rotation axis R shown in FIG. 7. Note that, in the present embodiment, the rotation axis R passes through the center of each circle formed by each of the inner frame 91, the middle frame 92, and the outer frame 94 (specifically, the frame portions 911, 921, and 941, which will be described later). Hereinafter, the direction of the rotation axis is merely referred to as an axial direction.

As shown in FIG. 5 to FIG. 8, the inner frame 91 includes a circular frame portion 911. The frame portion 911 has a thickness in the axial direction and in the radial direction. The inner frame 91 includes an adjustment portion 915, which can adjust the diameter of the inner frame 91. The diameter of the inner frame 91 can be adjusted according to the thickness of the work cloth 100 that is clamped between the inner frame 91 and the middle frame 92. The adjustment portion 915 includes a parting portion 916, a pair of screw mounting portions 917 and an adjusting screw 918. The parting portion 916 is a location where a portion in the circumferential direction of the frame portion 911 of the inner frame 91 is discontinuous through the axial direction. The pair of screw mounting portions 917 are provided on upper portions on both sides of the parting portion 916 in the frame portion 911. The pair of the screw mounting portions 917 project to the outside in the radial direction and are positioned opposite one another. The pair of screw mounting portions 917 have holes 9171 and 9172, respectively, that respectively pass through the screw mounting portions 917 in a direction that is orthogonal to the faces of the screw mounting potions 917 are opposite each other. Of the two holes 9171 and 9172, a nut (not shown in the drawings), in which a threaded hole is formed, is embedded in the one hole 9172 (the hole on the lower right side in FIG. 7).

The adjusting screw 918 is a screw that includes a head portion 9181 and a shaft portion 9183. The diameter of the head portion 9181 is larger than the diameter of the holes 9171 and 9172. The shaft portion 9183 is a part that extends integrally from the head portion 9181. The diameter of the shaft portion 9183 is equal to or smaller than the diameter of the holes 9171 and 9172. A male screw portion 9182 is formed on a part of the shaft portion 9183, closer to the leading end of the shaft portion 9183. The male screw portion 9182 can be screwed into the threaded hole of the nut embedded in the hole 9172. A narrow groove 9184, which can be engaged with a retaining ring 9185, is formed in a part of the shaft portion 9183 that is closer to the side of the head portion 9181. The adjusting screw 918 may be attached such that the shaft portion 9183 penetrates the hole 9171 and the threaded hole of the nut and the male screw portion 9182 are screwed together. In this state, the retaining ring 9185 may be engaged with the narrow groove 9184, and thus, the adjusting screw 918 can rotate in the screw mounting portion 917 on the side on which the hole 9171 is formed and cannot move in the axial direction. Note that an illustration of the retaining ring 9185 is omitted from the drawings apart from FIG. 7.

When the user holds the head portion 9181 of the adjusting screw 918 between his/her fingers and rotates the adjusting screw 918, the screw mounting portion 917 on the side on which the hole 9172 is formed moves in the axial direction of the shaft portion 9183, via the nut. The movement direction is determined by the rotation direction of the adjusting screw 918. In this way, the adjusting screw 918 can couple together the pair of screw mounting portions 917 and can perform adjustment to increase or reduce the gap between the pair of screw mounting portions 917. By adjusting the gap between the pair of screw mounting portions 917, the diameter of the inner frame 91 can be adjusted in accordance with the thickness of the work cloth 100. For example, by narrowing the gap between the pair of screw mounting portions 917, the diameter of the inner frame 91 becomes smaller. As a result, the embroidery frame 9 can clamp the work cloth 100 having a greater thickness between the middle frame 92 and the inner frame 91.

Figure 8:
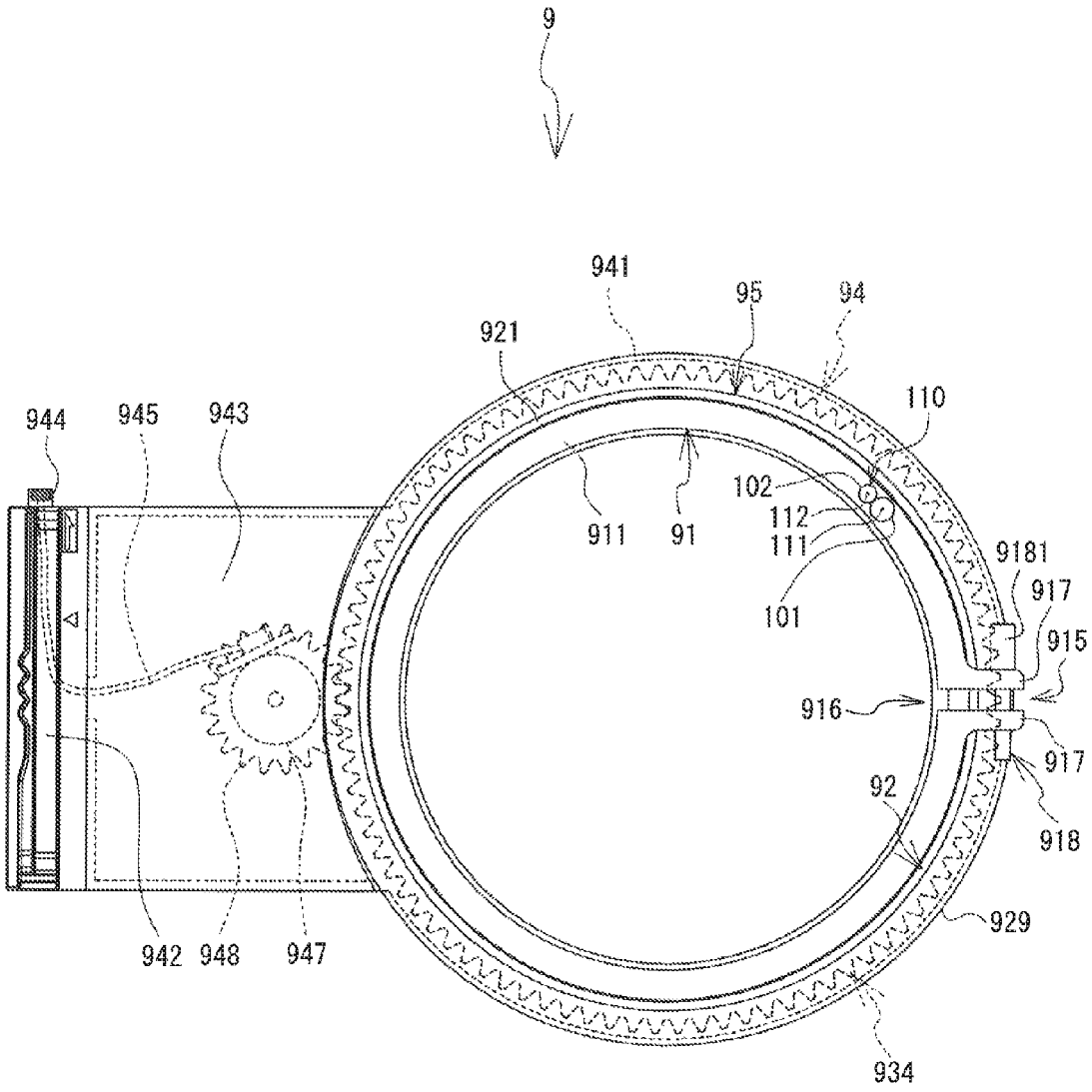
FIG. 8 is a plan view of the embroidery frame.

A marker 110 is provided on the upper surface of the inner frame 91. As shown in FIG. 8, the marker 110 includes a first circle 101, a second circle 102, a first center point 111 and a second center point 112, which are drawn on the upper surface of the inner frame 91. The second circle 102 and the first circle 101 are in contact with each other in the circumferential direction of the inner frame 91. The diameter of the second circle 102 is smaller than the diameter of the first circle 101. The first center point 111 is the center of the first circle 101. The second center point 112 is the center of the second circle 102.

As shown in FIG. 5 to FIG. 8, the middle frame 92 includes a circular frame portion 921. The inner diameter of the frame portion 921 is larger than the outer diameter of the frame portion 911 of the inner frame 91. The middle frame 92 can be attached to and removed from the inner frame 91 by attaching and removing the frame portion 921 of the middle frame 92 to and from the outer side, in the radial direction, of the frame portion 911 of the inner frame 91. As shown in FIG. 6 to FIG. 9, a master gear 934, that is a first gear wheel, is formed around the whole circumference of the outer circumferential side face in the lower portion of the frame portion 921. The master gear 934 can mesh with a pinion gear 948 (to be explained later).

A flange portion 929 is provided in a central portion in the axial direction of the outer circumferential side face of the frame portion 921 and on the upper side of the master gear 934. As described above, in the present embodiment, the axial direction corresponds to the up-down direction of the embroidery frame 9. The flange portion 929 is provided in the central portion in the up-down direction of the frame 921. The flange portion 929 projects outward in the radial direction around the whole circumference of the frame portion 921. A supporting portion 936 is provided on the inner circumferential side face of the lower end of the frame portion 921. The supporting portion 936 projects inward in the radial direction around the whole circumference of the frame portion 921. The supporting portion 936 is a portion that supports the lower end surface of the inner frame 91.

As shown in FIG. 5 to FIG. 8, the outer frame 94 includes a circular frame portion 941. A supporting portion 946 is provided on the inner circumferential side face of the lower end of the frame portion 941 (refer to FIG. 7). The supporting portion 946 projects inward in the radial direction around the whole circumference of the frame portion 941. The supporting portion 946 supports the lower end surface of the middle frame 92 and thus the frame portion 941 rotatably supports the middle frame 92 (refer to FIG. 9).

The attachment portion 942 is provided on the outer side in the radial direction of the frame portion 941. The attachment portion 942 is configured to be detachably mounted on the mounting adaptor 351 of the moving unit 19. The moving unit 19 may be mounted on the bed 11 of the sewing machine 1. Hereinafter, in order to simplify the explanation, it is stated that the mounting adaptor 351 is provided on the sewing machine 1. The frame side connector portion 944 is provided on one end (the end portion on the upper side in FIG. 8) of the attachment portion 942 that extends in the up-down direction in FIG. 8. The frame side connector portion 944 is a convex connector that can be connected to the concave sewing machine side connector portion 352. In a case where the attachment portion 942 is attached to the mounting adaptor 351, the frame side connector portion 944 is coupled and is electrically connected with the sewing machine side connector portion 352 (refer to FIG. 10). The frame side connector portion 944 is electrically connected to a motor 947 (to be described later) via conductive wiring 945.

Figure 6:
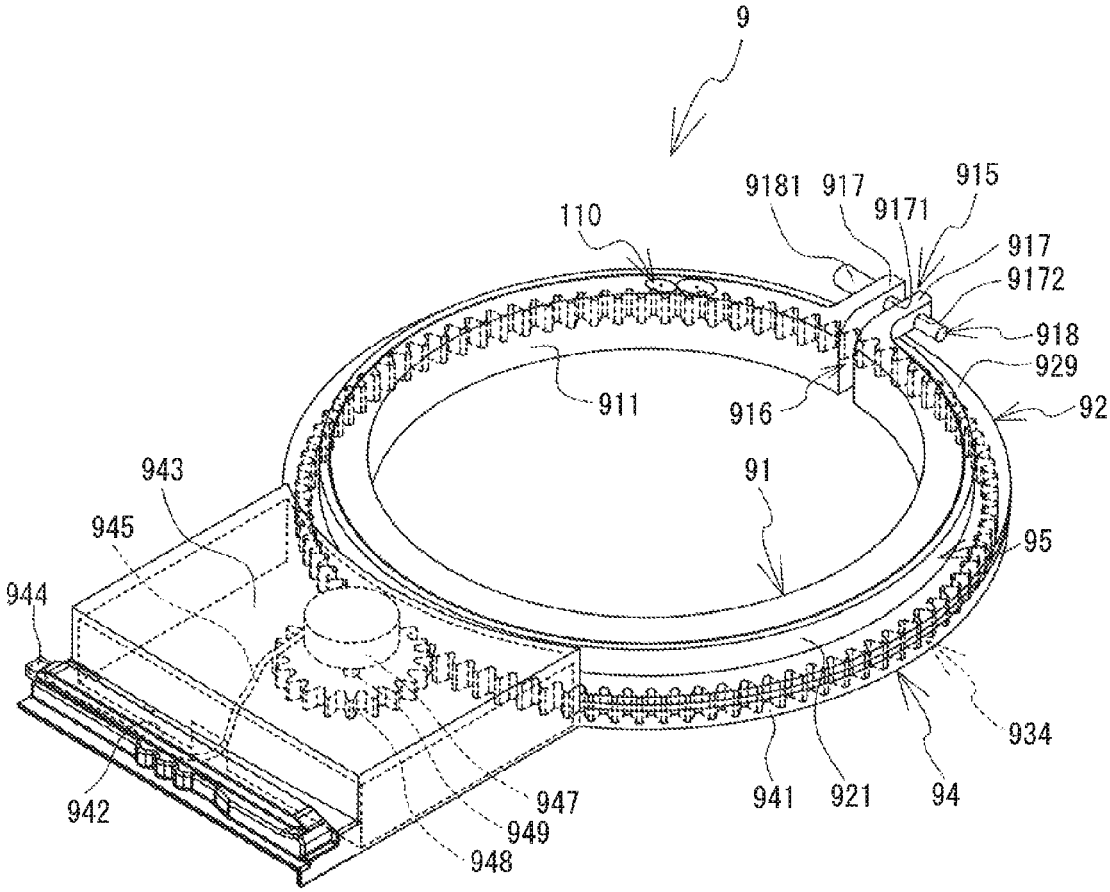
FIG. 6 is an oblique view that shows an internal structure of the embroidery frame shown in FIG. 5.
Figure 7:
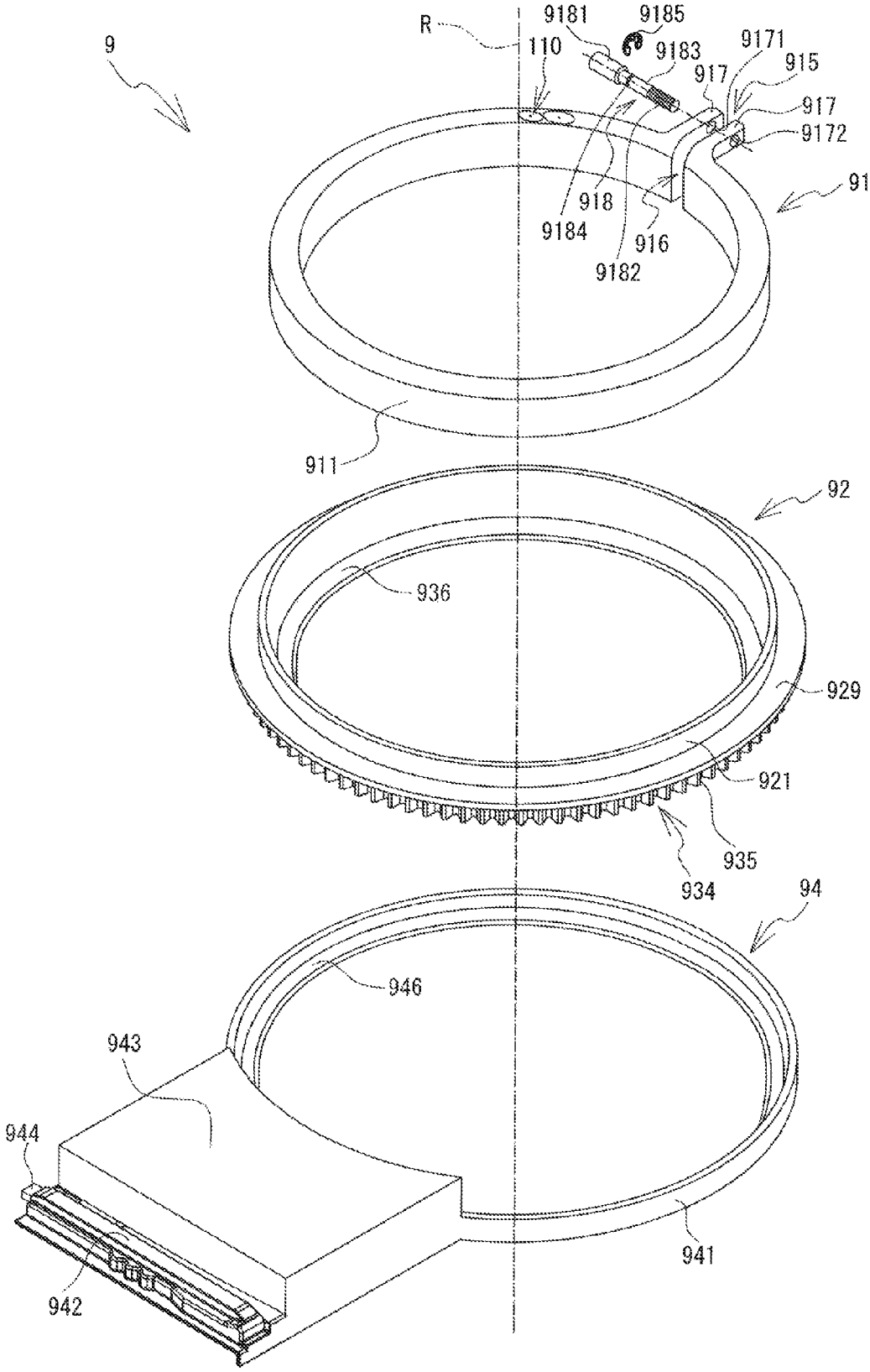
FIG. 7 is an exploded oblique view of the embroidery frame.
Figure 9:
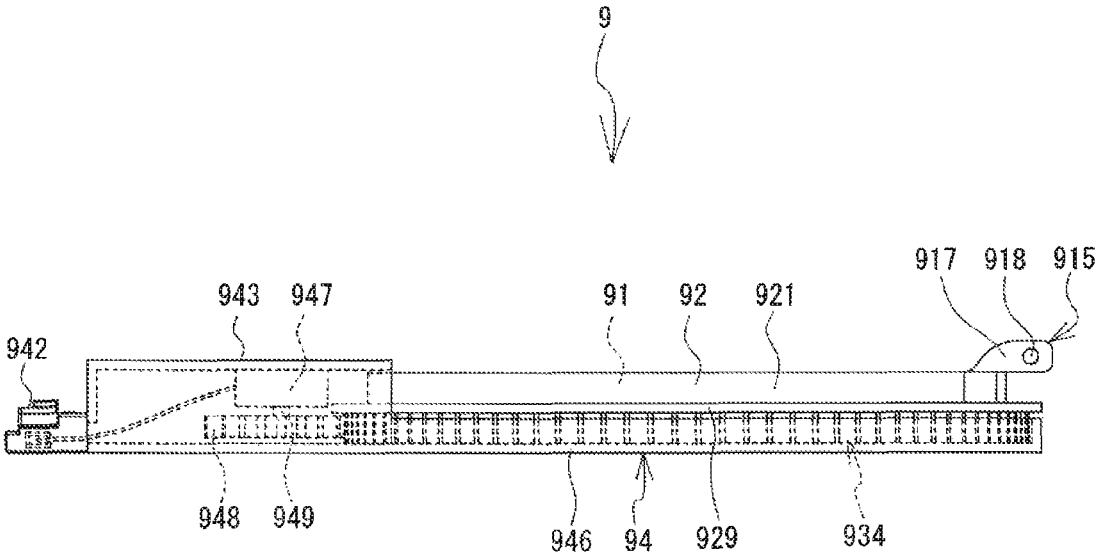
FIG. 9 is a side view of the embroidery frame.

A box-shaped storage portion 943 that joins the frame portion 941 and the attachment portion 942 is provided between the frame portion 941 and the attachment portion 942. As shown in FIG. 6, FIG. 8 and FIG. 9, the motor 947 is housed inside the storage portion 943.

The motor 947 is disposed in the storage portion 943 such that a rotating shaft 949 of the motor 947 is facing downward. The pinion gear 948, that is a second gear wheel, is fixed to the lower end of the rotating shaft 949. The diameter of the pinion gear 948 is smaller than that of the master gear 934 of the middle frame 92. The pinion gear 948 meshes with the master gear 934. When the motor 947 is driven and the pinion gear 948 is rotated, the master gear 934 rotates. As a result of this, the middle frame 92 rotates with respect to the outer frame 94. In other words, the motor 947 and the pinion gear 948 are configured to rotate the middle frame 92 with respect to the outer frame 94.

A mode in which the inner frame 91, the middle frame 92 and the outer frame 94 are combined and a mode in which the embroidery frame 9 is attached to the sewing machine 1 (the moving unit 19) will be explained. For example, the user may place the middle frame 92 on a work bench (not shown in the drawings) such that the master gear 934 is on the lower side. After that, the user may place the work cloth 100 on the middle frame 92. Then the user may insert the inner frame 91 into the inner side of the middle frame 92 while pressing the work cloth 100 downward with the bottom end of the inner frame 91. The work cloth 100 may be thus clamped between the inner frame 91 and the middle frame 92. At this time, the user may rotate the adjusting screw 918 as appropriate and adjusts the diameter of the inner frame 91 in accordance with the thickness of the work cloth 100. The face of the work cloth 100 on which the sewing will be performed may enter a state of being stretched taut on the inner side of the inner frame 91 at the bottom end of the inner frame 91. In the explanation that follows, the frame that is formed by the combining of the inner frame 91 and the middle frame 92 is called an assembled unit 95 (refer to FIG. 1). As described above, the assembled unit 95 is configured to hold the work cloth 100.

Next, the user may set the assembled unit 95 into the outer frame 94 from the top side of the outer frame 94. At this time, the user may place the assembled unit 95 in the frame portion 941 such that the master gear 934 and the pinion gear 948 mesh each other. In this way, the master gear 934 and the pinion gear 948 may be engaged with each other and the middle frame 92 (the assembled unit 95) may be locked with the outer frame 94. As described above, the inner frame 91, the middle frame 92 and the outer frame 94 can be combined to obtain the completed embroidery frame 9.

By attaching the attachment portion 942 of the embroidery frame 9 to the mounting adaptor 351 of the sewing machine 1, the user may attach the completed embroidery frame 9 to the sewing machine 1. At this time, the attachment portion 942 may be mounted on the mounting adaptor 351 while moving the attachment portion 942 from the front side (the lower side in FIG. 10) of the mounting adaptor 351 toward the rear side (the upper side in FIG. 10). In a case where the attachment portion 942 is mounted on the mounting adaptor 351, the sewing machine side connector portion 352 is coupled and is electrically connected with the frame side connector portion 944 (refer to FIG. 10). In this way, the sewing machine 1 (a CPU 61) may be electrically connected to the motor 947 via the sewing machine side connector portion 352, the frame side connector portion 944 and the conductive wiring 945. The sewing machine 1 may control the motor 947 and can thus rotate or lock the middle frame 92 (the assembled unit 95) with respect to the outer frame 94.

The electrical configuration of the sewing machine 1 will be explained with reference to FIG. 11. As shown in FIG. 11, a control portion 60 of the sewing machine 1 includes the CPU 61, a ROM 62, a RAM 63, an EEPROM 64 and an input/output interface 65, each of which are mutually connected by a bus 67. The ROM 62 stores programs to be used to execute processing by the CPU 61, and data etc. The EEPROM 64 includes at least a cutwork data storage area 641. The cutwork data storage area 641 stores a plurality of cutwork data tables, as example of which is a cutwork data table 59 (refer to FIG. 12). Further, the EEPROM 64 stores a plurality of embroidery data sets to be used for the sewing machine 1 to perform embroidery sewing.

The sewing start/stop switch 21, the touch panel 26 and drive circuits 71, 72, 75, 85, 86, 87 and 88 are electrically connected to the input/output interface 65. The drive circuit 71 may drive the feed amount adjustment pulse motor 78. The drive circuit 72 may drive the sewing machine motor 79. The drive circuit 75 may drive the liquid crystal display 15. The drive circuits 85 and 86 respectively may drive the X axis motor 83 and the Y axis motor 84 that move the embroidery frame 9. The drive circuit 87 may drive the image sensor 48. The CPU 61 may control the image sensor 48 and may cause the image sensor 48 to image an area that includes the embroidery frame 9 mounted on the mounting adaptor 351. The drive circuit 88 is connected to the sewing machine side connector portion 352. In a case where the frame side connector portion 944 is connected to the sewing machine side connector portion 352, the drive circuit 88 may drive the motor 947 that is provided in the embroidery frame 9. The CPU 61 may control the motor 947 and rotate the middle frame 92 (the assembled unit 95).

The cutwork data table 59 will be explained with reference to FIG. 12. The cutwork data table 59 shown in FIG. 12 is data for cutting areas 107 on inner sides of four petal patterns 106 of a flower pattern 105 (refer to FIG. 15) that is sewn on the work cloth 100. The cutwork data table 59 may be stored in the cutwork data storage area 641 (refer to FIG. 11).

As shown in FIG. 12, the cutwork data table 59 includes columns for items including a variable N, frame rotation data, X coordinates and Y coordinates. Data associated with each of these items may be stored. The variable N is a variable indicating an order in which a cut is to be formed in the work cloth 100. The frame rotation data is data indicating a rotation angle that is set in advance of the middle frame 92 with respect to the outer frame 94. The X coordinates and the Y coordinates are coordinates of needle drop points set in advance.

In the present embodiment, a position that a needle drop point matches a center point of the sewable area (hereinafter referred to as an initial position) is defines as an origin point (X, Y)=(0, 0) of an embroidery coordinate system. The sewable area may be set automatically in accordance with a type of the embroidery frame. In the present embodiment, the sewable area is a circle whose center is a center of rotation of the inner frame 91, and the center of the circle is the origin point. In the embroidery coordinate system, the left-right direction of the sewing machine 1 (the left-right direction in FIG. 15) is the X axis direction, and the front-rear direction of the sewing machine 1 (the up-down direction in FIG. 15) is the Y axis direction (refer to FIG. 15). The direction from the left to the right of the sewing machine 1 is the plus (+) direction of the X axis and the direction from the front to the rear is the plus (+) direction of the Y axis. With respect to the rotation angle, the X axis+side is a line of zero degrees (0°), and in FIG. 15, a counter-clockwise direction with respect to zero degrees is a plus (+) direction, and a clockwise direction with respect to zero degrees is a minus (−) direction, around the origin point (0, 0).

In the present embodiment, the middle frame 92 is adjusted, with respect to the outer frame 94, to the rotation angle based on the frame rotation data in an order of the variable N from "1" to "221", and a cut is formed in the work cloth 100 by the cutwork needle 8 (refer to FIG. 4) at a needle drop point defined by the X coordinate and the Y coordinate. The areas 107 (refer to FIG. 15) on the inner sides of the flower petal patterns 106 included in the flower pattern 105 are cut out in this manner.

Figure 15:
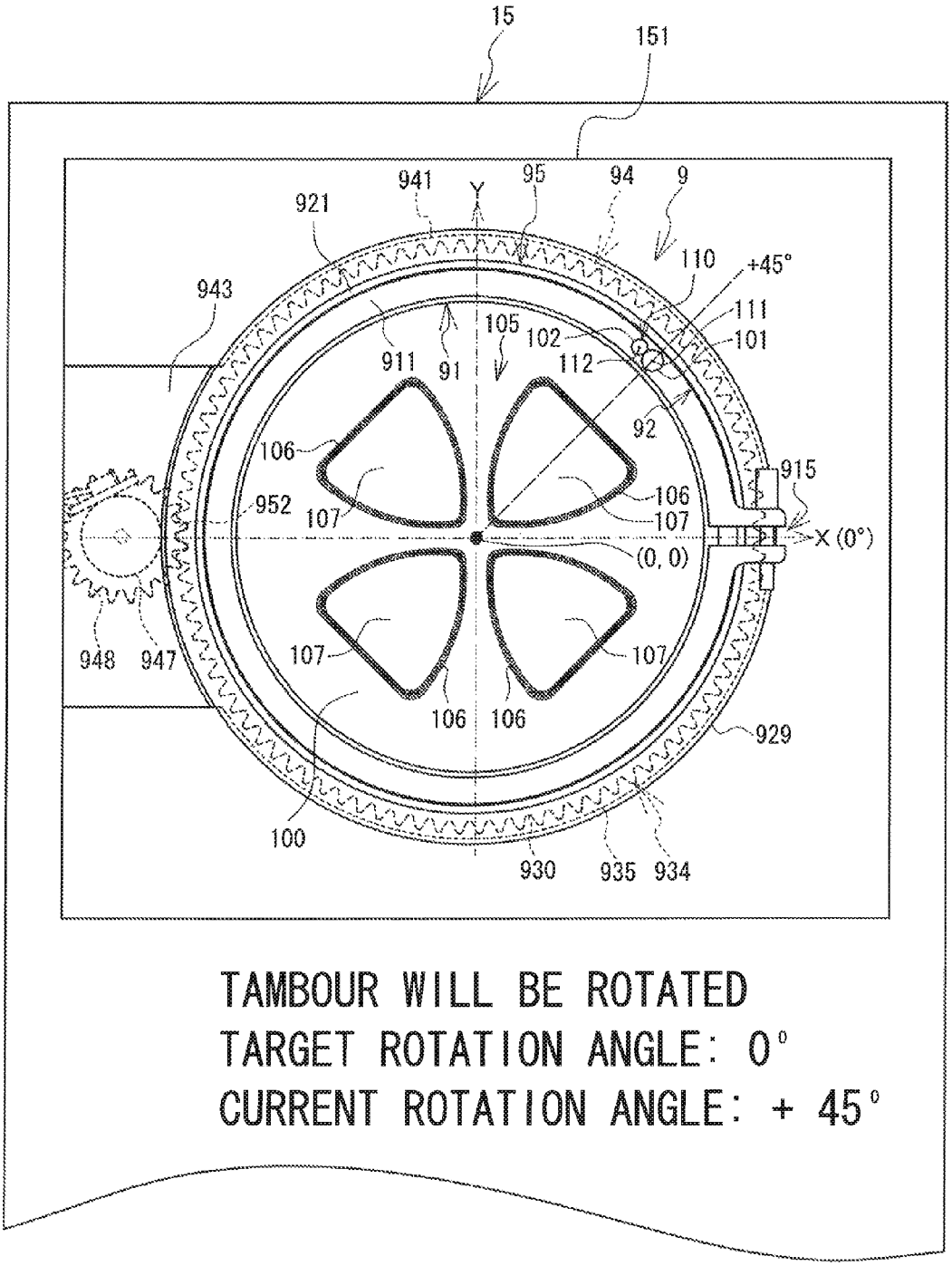
FIG. 15 is a figure showing an example of an image that is displayed on a liquid crystal display.

The four flower petal patterns 106 shown in FIG. 15 are formed, based on embroidery data stored in the EEPROM 64, by performing embroidery sewing in the form of satin stitches along the outlines of the four flower petal patterns 106. In the embroidery data includes the coordinates (the X coordinates and the Y coordinates) of the needle drop points arranged in the sewing order. By performing sewing on the work cloth 100 at the needle drop point coordinates in accordance with the sewing order, the sewing machine 1 performs embroidery sewing along the contours of the four flower petal patterns 106.

In the present embodiment, an angle that is formed between a virtual line, which joins the first center point 111 of the marker 110 and the origin point, and the + side of the X axis is defined as the rotation angle of the middle frame 92 with respect to the outer frame 94. The angles of rotation indicated by the frame rotation data of the cutwork data table 59 are set such that the areas 107 can be cut out after the embroidery sewing in a case in which, at the time of the embroidery sewing of the four flower petal patterns 106 based on the embroidery data, the rotation angle of the middle frame 92 with respect to the outer frame 94 is zero degrees. Thus, for example, if the rotation angle of the middle frame 92 with respect to the outer frame 94 is "+45 degrees" when embroidery sewing of the four flower petal pattern embroidery frames 106 is performed, the cutwork data is corrected based on "+45 degrees." The cuts are formed based on the corrected cutwork data (refer to step S15 in FIG. 13, which will be described in more detail later).

Cutwork processing that is performed by the CPU 61 of the sewing machine 1 will be explained with reference to FIG. 13 to FIG. 18. In the explanation that follows, a specific example will be explained of a case in which a cutwork of the flower pattern 105 is formed by cutting out the areas 107 on the inner sides of the four flower petal patterns 106 shown in FIG. 15. In the following specific example, after embroidery sewing of the four flower petal patterns 106 is performed, the cuts are subsequently formed without removing the work cloth 100 from the embroidery frame 9.

Immediately before or immediately after performing the embroidery sewing of the four flower petal patterns 106 based on the embroidery data, the CPU 61 causes the image sensor 48 to image an area including the embroidery frame 9. The CPU 61 detects the marker 110 in the image imaged by the image sensor 48. The CPU 61 calculates an angle of a virtual line that joins the origin point (the center of the tambour 9) and the coordinate position of the first center point 111 of the first circle 101 with respect to the+side of the X axis (the rotation angle of the middle frame 92 with respect to the outer frame 94). The CPU 61 stores results of the calculation in the RAM 63. In the specific example, the rotation angle of the middle frame 92 with respect to the outer frame 94 is +45 degrees when the embroidery sewing of the four flower petal patterns 106 is performed. Thus, data indicating 45 degrees is stored in the RAM 63. Therefore, for example, even if the user manually rotates the middle frame 92 by 10 degrees after the embroidery sewing, the CPU 61 can determine the rotation angle of the middle frame 92 using the marker 110, and can thus recognize that the middle frame 92 has been rotated by 10 degrees since the time of performing the embroidery sewing.

When cutting out the areas 107 on the inner sides of the four flower petal patterns 106, the user mounts the cutwork needle 8 in the needle bar 6. At this time, the cutwork needle 8 is fixed in place such that the width of the cutting portion 89 corresponds to the front-rear direction of the sewing machine 1, as shown in FIG. 4. Therefore, in order to cut out all of the four areas 107 in the work cloth 100, it is necessary to change the rotation angle of the middle frame 92 (the assembled unit 95) with respect to the outer frame 94 a plurality of times. Thus, by performing the cutwork processing, the sewing machine 1 changes the rotation angle of the middle frame 92 with respect to the outer frame 94, and cuts out the areas 107.

Figure 13:
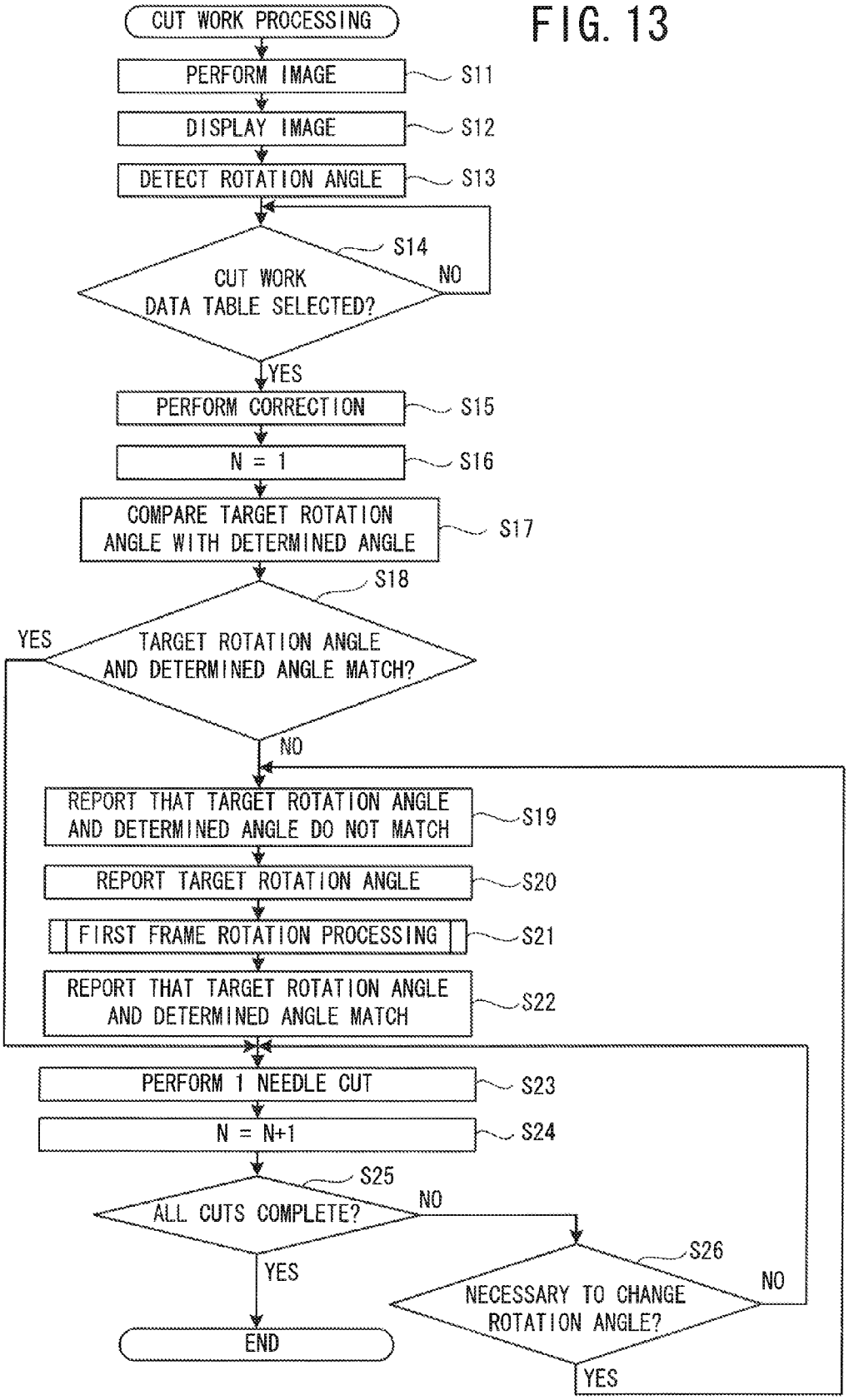
FIG. 13 is a flowchart of cutwork processing.

As shown in FIG. 13, in the cutwork processing, first, the embroidery frame 9 is moved to the initial position, such that the needle drop point is at the center of the embroidery frame 9 (the origin point). After the embroidery frame 9 is moved, the image sensor 48 is controlled and images an area including the embroidery frame 9 that is mounted on the mounting adaptor 351 (step S11). An image 151 imaged at step S11 is displayed on the liquid crystal display 15 (step S12). An example of the displayed image 151 is shown in FIG. 15. Note that, for the purpose of explanation, only a part of the work cloth 100 that is on the inner side of the inner frame 91 is illustrated (this also applies to FIG. 17 and FIG. 18).

The marker 110 that is provided on the embroidery frame 9 is detected from the image 151 imaged by the image sensor 48, and the rotation angle of the middle frame 92 with respect to the outer frame 94 is determined based on the detected marker 110 (step S13). For example, when the image 151 shown in FIG. 15 is imaged, the marker 110 that is provided on the embroidery frame 9 is detected. In order to detect the marker 110, for example, pattern matching between feature points extracted from the image 151 and a template stored in the ROM 62 or EEPROM 64 in advance may be employed. Then, the angle between the virtual line that joins the origin point (the center of the embroidery frame 9) to the coordinate position of the first center point 111 of the first circle 101 and the "zero degree" line that is the + side of the X axis, namely, the rotation angle of the middle frame 92 with respect to the outer frame 94, is detected. In the explanation that follows, the rotation angle of the middle frame 92 with respect to the outer frame 94 that is determined at step S13 or at step S34 (to be explained later) is referred to as a determined angle. In the specific example shown in FIG. 15, the determined angle is "+45 degrees (+45°)." More specifically, the rotation angle of the middle frame 92 (+45 degrees) at the time of performing the embroidery sewing that is stored in the RAM 63 is the same as the current rotation angle of the middle frame 92.

It is determined whether or not one of the cutwork data tables is selected (step S14). At step S14, a plurality of cutwork patterns are displayed on the liquid crystal display 15, and the user can select one of the cutwork patterns by a panel operation. When one of the outwork patterns is selected by the user, it is determined that a corresponding cutwork data table has been selected (yes at step S14). The sewing machine 1 is on stand-by as long as the cutwork data table is not selected (no at step S14). In the specific example, the cutwork data table 59 (refer to FIG. 12) for cutting out the areas 107 on the inner sides of the flower petal patterns 106 is selected.

When the cutwork data table 59 is selected (yes at step S14), the cutwork data table 59 is corrected in accordance with the current rotation angle (the determined angle) of the middle frame 92 (step S15). The rotation angle of the middle frame 92 with respect to the outer frame 94 when performing the embroidery sewing of the four flower petal patterns 106, namely, "+45 degrees," is stored in the RAM 63. At step S15, the frame rotation data of the cutwork data table 59 are corrected based on "+45 degrees" that is stored in the RAM 63. For example, the rotation angle "+45 degrees" stored in the RAM 63 is added to the frame rotation data of the cutwork data table 59 shown in FIG. 12, and the frame rotation data of the cutwork data table 59 are corrected to frame rotation data values of a cutwork data table 591 shown in FIG. 16. For example, a value of the corresponding frame rotation data when the variable N is 1 is corrected from "−45 degrees" (refer to FIG. 12) to "zero degrees" (refer to FIG. 16). Further, at step S15, after the frame rotation data have been corrected, the X coordinates and Y coordinates are also corrected. The X coordinates and the Y coordinates of the cutwork data table 59 are converted to X' coordinates and Y' coordinates. Specifically, when the rotation angle of the middle frame 92 is θ, the original coordinate values are x, y, and the coordinate values after conversion are u, v, conversion is performed using the formulas noted below. The cutwork data table 59 is corrected in this manner and the cutwork data table 591 shown in FIG. 16 is generated.

$$u = x\cos\theta - y\sin\theta$$

$$v = x\sin\theta + y\cos\theta$$

The variable N is set as "1" and is stored in the RAM 63 (step S16). A target rotation angle is compared to the determined angle determined at step S13 (step S17). The target rotation angle is a rotation angle indicated by the frame rotation data of the cutwork data table 591. It is determined whether or not the target rotation angle matches the determined angle (step S18). When the target rotation angle matches the determined angle (yes at step S18), the processing advances to step S23 (to be described later).

In the specific example, the target rotation angle corresponding to the variable N "1" is "zero degrees" (refer to FIG. 16). Thus, it is determined that the target rotation angle "zero degrees" and the determined angle "+45 degrees" do not match (no at step S18). When the target rotation angle and the determined angle do not match (no at step S18), information indicating that the target rotation angle and the determined angle do not match is reported (step S19). At step S19, for example, a message "The embroidery frame will be rotated" is displayed on the liquid crystal display 15 (refer to FIG. 15). In this way, the user can recognize that the target rotation angle and the determined angle do not match each other. Further, the user can recognize that the sewing machine 1 will perform an operation to rotate the middle frame 92. As a result, it is possible to inhibit the user from arbitrarily rotating the middle frame 92 (the assembled unit 95).

Next, the target rotation angle is reported (step S20). At step S20, for example, a message "Target rotation angle: zero degrees (0°)" is displayed on the liquid crystal display 15 (refer to FIG. 15). In this way, the user can recognize that the sewing machine 1 will rotate the middle frame 92 to "zero degrees." Next, first frame rotation processing is performed (step S21).

Figure 14:
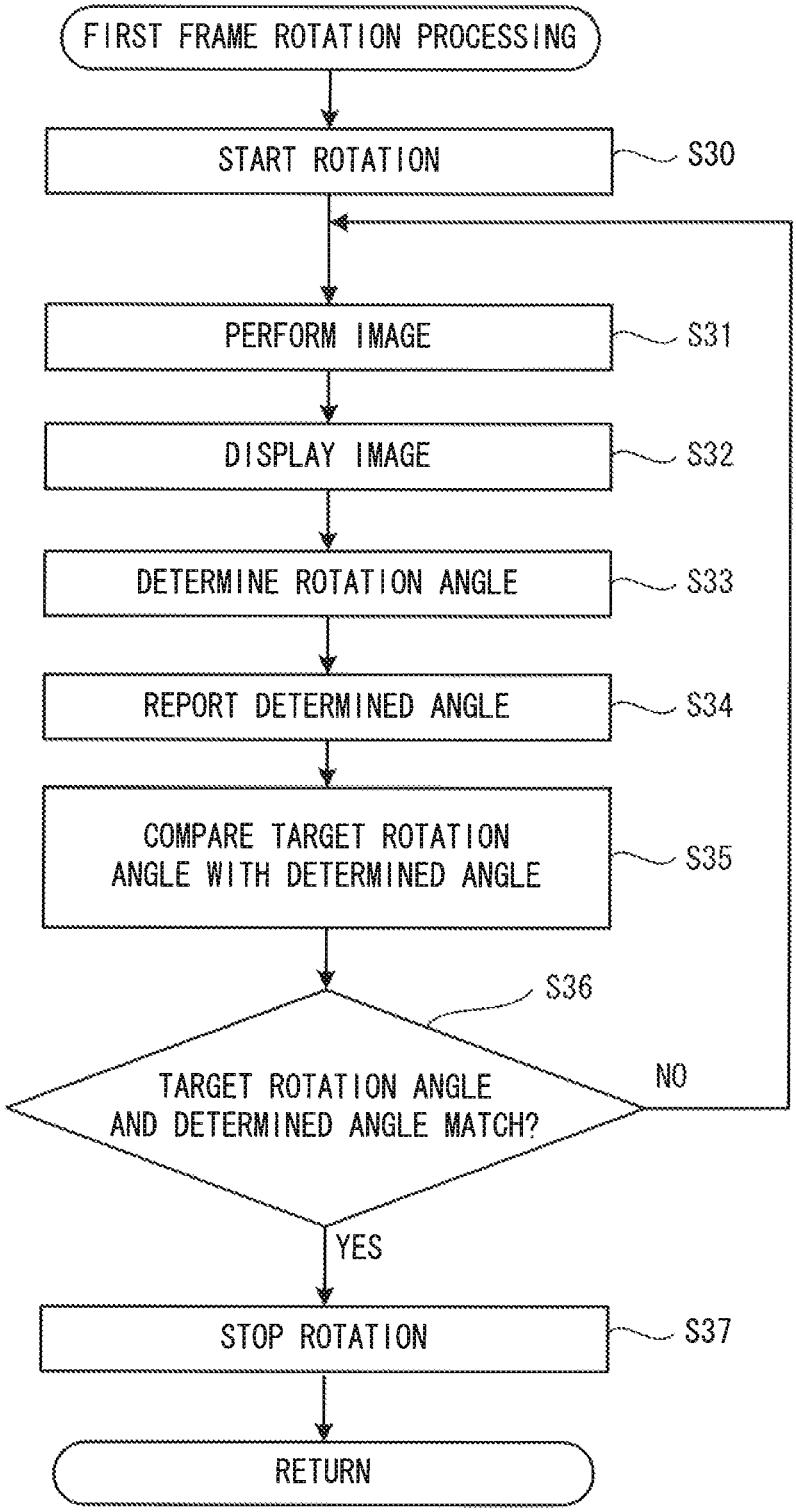
FIG. 14 is a flowchart of first frame rotation processing.

The first frame rotation processing will be explained with reference to FIG. 14. The first frame rotation processing is processing in which the sewing machine 1 rotates the middle frame 92 (the assembled unit 95) and matches the rotation angle of the middle frame 92 with respect to the outer frame 94 with the target rotation angle. As shown in FIG. 14, in the first frame rotation processing, the motor 947 is controlled and the rotation of the middle frame 92 is started toward the target rotation angle (step S30). Namely, when the target rotation angle and the determined angle do not match, the motor 947 is controlled and the middle frame 92 is rotated. In processing that follows, the CPU 61 controls the motor 947 and rotates the middle frame 92 until the rotation of the middle frame 92 is stopped at step S37 (to be described later).

Next, similarly to the processing at step S11 (refer to FIG. 13), the image sensor 48 is controlled and images an area that includes the embroidery frame 9 mounted on the mounting adaptor 351 (step S31). After this, the image 151 imaged at step S31 is displayed on the liquid crystal display 15 (step S32). Then, similarly to the processing at step S13 (refer to FIG. 13), the marker 110 that is marked on the embroidery frame 9 is detected from the imaged image 151. The rotation angle of the middle frame 92 with respect to the outer frame 94 is determined based on the detected marker 110 (step S33).

The determined angle detected at step S33 is reported (step S34). In the specific example, the determined angle is displayed on the liquid crystal display 15. In this way, the user can clearly recognize the current rotation angle. In the specific example, the determined angle is "+45 degrees," and thus a message "Current rotation angle: +45 degrees (+45°)" is displayed on the liquid crystal display 15 (refer to FIG. 15).

Similarly to the processing at step S17 (refer to FIG. 13), the target rotation angle is compared to the determined angle (step S35). Similarly to the processing at step S18 (refer to FIG. 13), as a result of the comparison at step S35, it is determined whether or not the target rotation angle matches the determined angle (step S36). When the target rotation angle does not match the determined angle (no at step S36), the processing returns to step S31. The processing from step S31 to step S36 is repeated until the target rotation angle and the determined angle match each other. In other words, the CPU 61 controls the motor 947 to adjust an amount of rotation of the middle frame 92 with respect to the outer frame 94 based on the determined angle and the target rotation angle. While the sewing machine 1 is adjusting the rotation angle of the middle frame 92 by repeating the processing from step S31 to step S36, the image 151 of the embroidery frame 9 is imaged and displayed on the liquid crystal display 15 in real time (step S31 and step S32). Further, the current rotation angle of the middle frame 92 with respect to the outer frame 94 (the determined angle) is displayed on the liquid crystal display 15 in real time (step S34).

Figure 17:
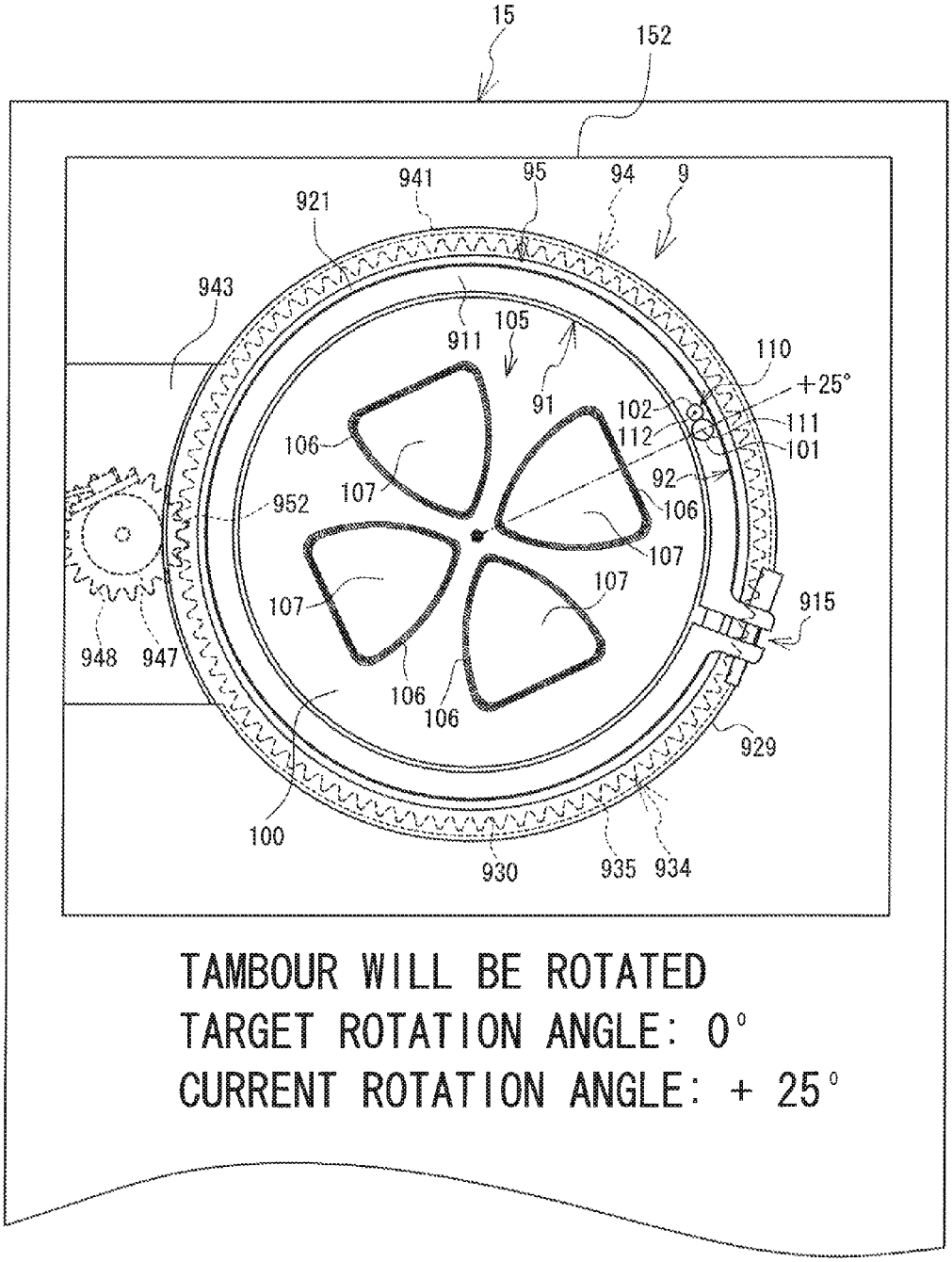
FIG. 17 is a figure showing another example of an image that is displayed on the liquid crystal display.

For example, when the CPU 61 rotates the middle frame 92 in the clockwise direction to a position of "+25 degrees," an image 152 in which the middle frame 92 is rotated as far as "+25 degrees" and a message "Current rotation angle: +25 degrees" are displayed on the liquid crystal display 15, as shown in FIG. 17. Then, as in an image 153 shown in FIG. 18, when the middle frame 92 is rotated as far as a position of "zero degrees," it is determined that the target rotation angle and the determined angle match each other (yes at step S36). When the target rotation angle and the determined angle match each other, the motor 947 is controlled and the rotation of the middle frame 92 is stopped (step S37). The first frame rotation processing ends and the processing advances to step S22 (refer to FIG. 13).

As shown in FIG. 13, at step S22, information indicating that the determined angle and the target rotation angle match each other is reported (step S22). At step S22, for example, a message "The rotation angle matches the target rotation angle" is displayed on the liquid crystal display 15 (refer to FIG. 18). In this way, the user can easily recognize that the rotation angle of the middle frame 92 with respect to the outer frame 94 matches the rotation angle based on the frame rotation data (the target rotation angle).

Figure 18:
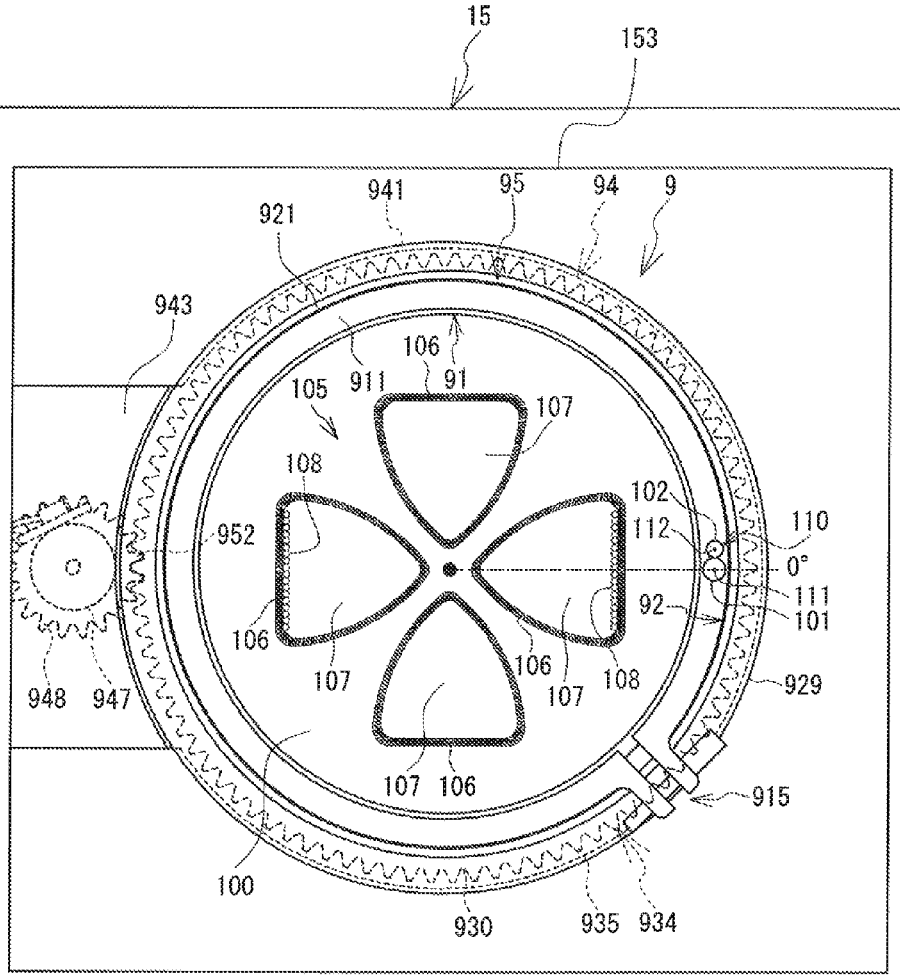
FIG. 18 is a figure showing yet another example of an image that is displayed on the liquid crystal display.

Next, based on the data of the outwork data table 591, an Nth cut is formed corresponding to the variable N value (step S23). For example, when the variable N is "1," the X coordinate is "u1" and the Y coordinate is "v1." As a result, the X axis motor 83 and the Y axis motor 84 are driven and the embroidery frame 9 is moved such that the X coordinate of the needle drop point is "u1" and the Y coordinate of the needle drop point is "v1." Then, the needle bar 6 is driven and a cut is formed by the outwork needle 8 at a position where the X coordinate is "u1" and the Y coordinate is "v1" on the work cloth 100 (refer to FIG. 18). In FIG. 18, a row of white circles represent needle drop points 108 of the cutwork needle 8 for forming cuts in the work cloth 100 when the rotation angle based on the frame rotation data is "zero degrees" (when the variable N is "1" to "36"). In the present embodiment, the cuts are formed in the work cloth 100 such that the white circles are joined together in the front-rear direction (the direction of the cutting portion 89 of the cutwork needle 8) of the sewing machine 1.

The variable N is incremented by 1 (step S24). Next, it is determined whether or not forming of all the cuts is complete (step S25). At step S25, it is determined whether or not the forming of all of the cuts has been completed by determining whether or not the data, such as the frame rotation data, corresponding to the value of the incremented variable N exist in the outwork data table 591. For example, when the incremented variable N is "222," there is no corresponding data in the cutwork data table 591. In this case, it is determined that the forming of all of the cuts is complete.

When the forming of all of the cuts is not complete (no at step S25), it is determined whether or not it is necessary to change the rotation angle of the middle frame 92 with respect to the outer frame 94, by determining whether or not the rotation angle based on the frame rotation data has changed in the cutwork data table 591 (step S26). For example, in the cutwork data table 591 (refer to FIG. 16), while the value of the variable N is any of the values from "1" to "36," the frame rotation data remains as "zero degrees" and does not change. As a result, while the value of the variable N is any of the values from "1" to "36," it is determined that it is not necessary to change the rotation angle of the middle frame 92 with respect to the outer frame 94 (no at step S26), and the processing returns to step S23. The forming of the cuts continues.

In the specific example, when the variable N is incremented from "36" to "37" at step S24, the frame rotation data changes from "zero degrees" to "+45 degrees" (refer to FIG. 12). Thus, it is determined that it is necessary to change the rotation angle of the middle frame 92 with respect to the outer frame 94 (yes at step S26), and the processing returns to step S19. Information indicating that the target rotation angle of "+45 degrees" and the determined angle do not match each other is reported (step S19), and the target rotation angle is reported (step S20). The CPU 61 performs the first frame rotation processing, and adjusts the rotation angle of the middle frame 92 with respect to the outer frame 94 to "+45 degrees," which is the target rotation angle. When the determined angle and the target rotation angle of "+45 degrees" match each other (yes at step S36), the forming of a cut at the target rotation angle of "+45 degrees" is performed (step S23 to step S26).

After this also, the rotation of the middle frame 92 and the forming of the cuts in the work cloth 100 is repeated and thus the forming of the cuts continues. When it is determined that the forming of the cuts is completed (yes at step S25), the cutwork processing is ended. In this way, all of the areas 107 on the inner sides of the four flower petal patterns 106 are cut out and the completed flower pattern 105 is obtained.

As described above, the cutwork processing is performed using the embroidery frame 9. In the present embodiment, the motor 947 and the pinion gear 948 that are configured to rotate the middle frame 92 with respect to the outer frame 94 are provided on the embroidery frame 9, while the X axis moving mechanism, the Y axis moving mechanism, the X axis motor 83 and the Y axis motor 84 etc. that are configured to move the embroidery frame 9 in the X direction and the Y direction are provided not on the embroidery frame 9 but on the sewing machine 1. As a result, in comparison to a configuration of a known sewing machine, it is possible to inhibit a driver to rotate the embroidery frame 9 from increasing in size.

When it is determined that the rotation angle based on the frame rotation data (the target rotation angle) and the determined angle do not match each other (no at step S18 or no at step S36), the CPU 61 can rotate the middle frame 92, and when the target rotation angle and the determined angle match each other, the CPU 61 can stop the rotation of the middle frame 92 (step S37). Thus, the sewing machine 1 can automatically adjust the rotation angle of the middle frame 92 to the rotation angle based on the frame rotation data.

When it is determined that the rotation angle based on the frame rotation data (the target rotation angle) and the determined angle match each other (yes at step S18 or yes at step S36), the needle bar 6 is driven and the forming of the cuts on the work cloth 100 is performed (step S23). Further, when the target rotation angle and the determined angle do not match each other (no at step S18 or no at step S36), the needle bar 6 is not driven and the forming of the cuts on the work cloth 100 is not performed. It is therefore possible to inhibit the cuts from being formed mistakenly in the work cloth 100 when the rotation angle based on the frame rotation data and the determined angle do not match each other.

Figure 10:
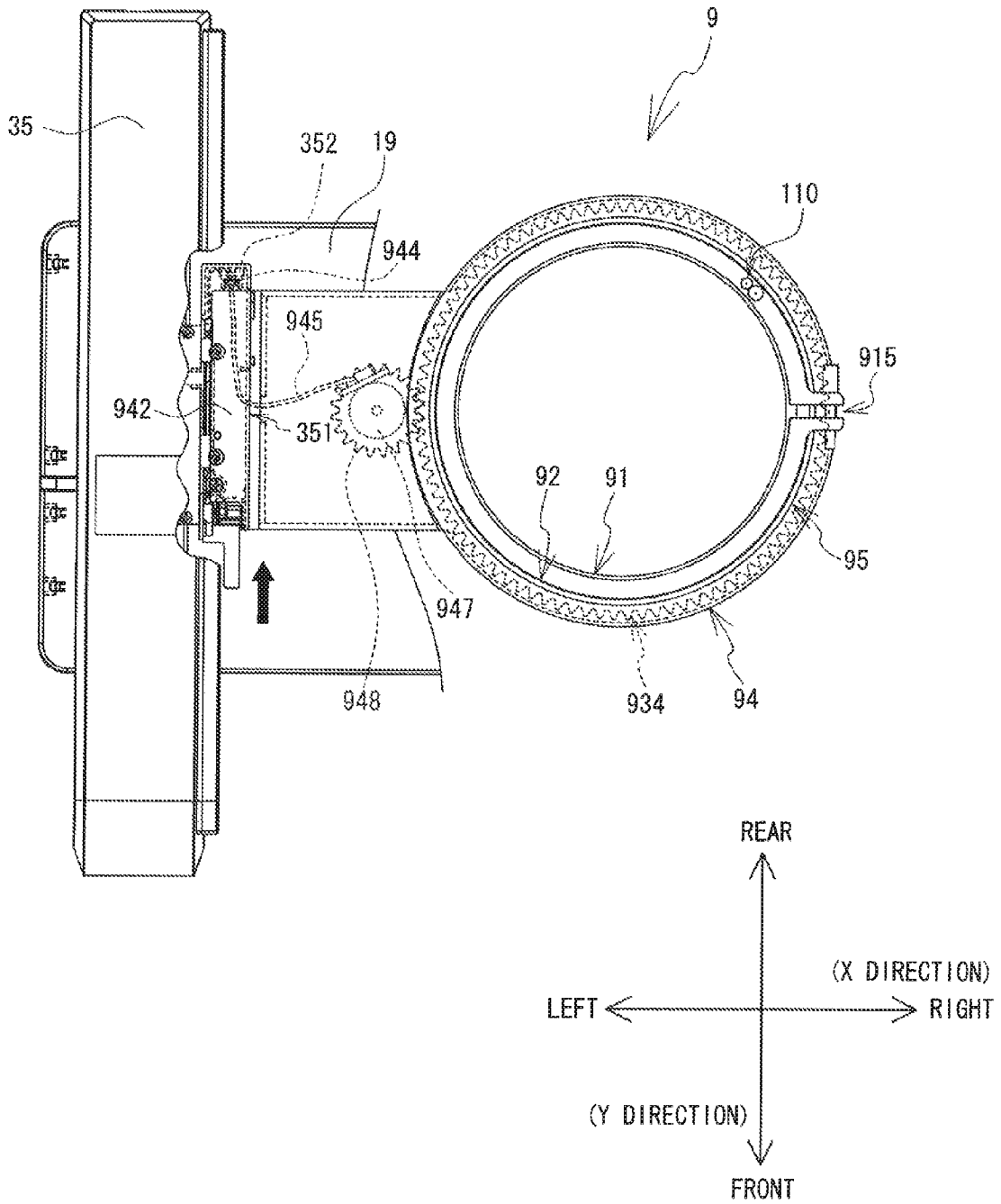
FIG. 10 is a plan view of the embroidery frame in a state in which an attachment portion is mounted on the mounting adaptor.

In a case where the embroidery frame 9 is mounted on the mounting adaptor 351, the frame side connector portion 944 and the sewing machine side connector portion 352 are coupled together and are electrically connected (refer to FIG. 10). Thus, it is not necessary to separately perform the operation to mount the embroidery frame 9 on the mounting adaptor 351 and the operation to couple the sewing machine side connector portion 352 and the frame side connector portion 944. As a result, convenience for the user can be improved.

On the outer frame 94 of the embroidery frame 9, the motor 947 is provided inside the storage portion 943, which is disposed between the attachment portion 942 and the frame portion 941 that is configured to hold the middle frame 92. The attachment portion 942 is a part that is configured to be attached to the mounting adaptor 351 of the sewing machine 1 and thus supported. In other words, the motor 947 is positioned close to the attachment portion 942 that is the part to be supported by the mounting adaptor 351. Thus, for example, the embroidery frame 9 can be made smaller, compared to a case in which the motor 947 is positioned in a location that is separated from the storage portion 943 joining the frame portion 941 and the attachment portion 942. In addition, the heavy motor 947 can be positioned close to the mounting adaptor 351. As a result, the center of gravity of the embroidery frame 9 as a whole can be positioned close to the mounting adaptor 351, and the embroidery frame 9 can be thus stably supported by the mounting adaptor 351.

The driver that is configured to rotate the middle frame 92 can be realized by the simple configuration formed of the motor 947 and the pinion gear 948. Further, the motor 947 and the pinion gear 948 are provided on the outer frame 94. As a result, it is possible to inhibit an increase in size of the mounting adaptor 351, which is the part of the sewing machine 1 on which the embroidery frame 9 is mounted, and the carriage cover 35.

The marker 110 is provided on the inner frame 91 and thus, the position of the marker 110 may change in accordance with the rotation of the inner frame 91 and the middle frame 92 with respect to the outer frame 94. Accordingly, the sewing machine 1 can image the marker 110 using the image sensor 48 and can determine the rotation angle of the middle frame 92 with respect to the outer frame 94 using the image of the marker 110. In other words, the embroidery frame 9 allows the sewing machine 1 to determine the rotation angle of the middle frame 92.

The embroidery frame 9 is configured such that the middle frame 92 can rotate with respect to the outer frame 94, and the sewing machine 1 automatically performs the forming of the cuts while controlling the motor 947 and rotating the middle frame 92. Thus, it is not necessary for the user to manually rotate the middle frame 92 with respect to the outer frame 94. As a result, convenience for the user can be improved.

The present disclosure is not limited to the above-described embodiment, and various modifications are possible. For example, in the above explanation, various pieces of information are displayed on the liquid crystal display 15 and thus reported to the user (step S19, step S20, step S22 in FIG. 13 and step S34 in FIG. 14), but the method of reporting is not limited to this example. For example, the sewing machine 1 may be provided with a light emitting diode (LED). The various pieces of information may be reported to the user by the LED illuminating or flashing etc., when the determined angle matches the target rotation angle, or when the determined angle does not match the target rotation angle etc. Further, the various pieces of information need not necessarily be reported to the user.

The frame side connector portion 944 need not necessarily be coupled to the sewing machine side connector portion 352 and electrically connected, in a case where the attachment portion 942 of the embroidery frame 9 is attached to the mounting adaptor 351. For example, the embroidery frame 9 and the sewing machine 1 may be configured such that the operation to attach the attachment portion 942 of the embroidery frame 9 to the mounting adaptor 351, and the operation to couple the sewing machine side connector portion 352 and the frame side connector portion 944 are performed separately.

In the above explanation, the embroidery frame 9 includes the pinion gear 948, the motor 947 and the master gear 934, the pinion gear 948 meshes with the master gear 934 of the middle frame 92, and the motor 947 and the pinion gear 948 rotate the middle frame 92. However, the structure of the embroidery frame is not limited as long as the middle frame 92 (the assembled unit 95) can be rotated with respect to the outer frame 94 by the control of the CPU 61. A shape of the embroidery frame 9 is not limited to the shape of the above-described embodiment.

The marker 110 may be provided by a method different to the above-described embodiment. For example, the marker 110 may be drawn on one face of a sheet having a predetermined size, adhesive being applied to the other face of the sheet. This sheet may be adhered onto the work cloth 100 that is clamped between the inner frame 91 and the middle frame 92. In this case, the marker 110, which is adhered onto the work cloth 100 that is held by the embroidery frame 9, may be detected from the image and the rotation angle of the middle frame 92 with respect to the outer frame 94 may be determined based on the detected marker 110 (step S13 and step S33). A shape, design, color and like of the marker is not limited to the marker 110 in the above described embodiment. Any configuration of the marker may be employed, as long as the position of the marker can be detected from the image.

Both the embroidery sewing and the forming of the cuts need not necessarily be performed with respect to the work cloth 100 that is attached to the embroidery frame 9. For example, the user may first use another embroidery frame that is larger than the embroidery frame 9 to perform embroidery sewing of an embroidery pattern that includes the flower petal patterns 106 of the flower pattern 105 on the work cloth 100. After that, the user may remove the work cloth 100 from the other embroidery frame, attach the work cloth 100 to the embroidery frame 9 and then perform the forming of the cuts using the sewing machine 1 to cut out the areas 107. In this case, a position (coordinates corresponding to the origin point) of the flower pattern 105 that is embroidery sewn using the other embroidery frame is different to a position (coordinates corresponding to the origin point) of the flower pattern 105 when the work cloth 100 is attached to the embroidery frame 9. However, the areas 107 of the flower pattern 105 can be cut out by performing processing in the following manner, for example.

For example, after the sewing machine 1 has performed the embroidery sewing of the flower petal patterns 106 on the work cloth 100 that is attached to the other embroidery frame, the user adheres the sheet, on which the marker 110 has been drawn, onto the work cloth 100. Using the image sensor 48, the sewing machine 1 (the CPU 61) images an area including the marker 110. The sewing machine 1 detects the marker 110 from the image. The sewing machine 1 stores, in the RAM 63, information of positional relationships (hereinafter referred to as pattern position information) between the four flower petal patterns 106, the first center point 111 and the second center point 112 when the embroidery sewing is performed. The user removes the work cloth 100 from the other embroidery frame and attaches the work cloth 100 to the embroidery frame 9 in a state in which the sheet, on which the marker 110 is drawn, remains adhered to the work cloth 100. After that, the sewing machine 1 images an area that includes the marker 110 and acquires coordinates of the first center point 111 and the second center point 112 of the marker 110. Based on the pattern position information when the work cloth 100 was attached to the other embroidery frame and on the acquired coordinates of the first center point 111 and the second center point 112, the sewing machine 1 specifies a center position of the four flower petal patterns 106 and angles of the flower petal patterns 106 with respect to the X axis. The sewing machine 1 calculates correction values for the frame rotation data, the X coordinates and the Y coordinates in the cutwork data table 59, such that it is possible to cut out the areas 107 of the four flower petal patterns 106 in the specified position and at the specified angles. The sewing machine 1 uses the corrected cutwork data table 59 and cuts out the areas 107. If the processing is performed in this manner, even if the work cloth 100 is removed from the other embroidery frame and attached to the embroidery frame 9, it is possible to cut out the areas 107. Note that methods to calculate the rotation angle of the middle frame 92, the position of the flower pattern 105 and the correction values to cut out the areas 107 are not limited in any way, and various methods can be adopted that allow calculation using the marker 110 in the image.

As long as the amount of rotation of the middle frame 92 can be controlled by controlling the motor 947 based on the determined angle and the frame rotation data, the method of adjusting the rotation angle of the middle frame 92 is not particularly limited. For example, the sewing machine 1 may adjust the rotation angle of the middle frame 92 by calculating a difference between the determined angle and the target rotation angle and then controlling the motor 947 and rotating the middle frame 92 by an angle that corresponds to the calculated difference. Hereinafter, processing according to this modified example will be explained with reference to FIG. 19.

Figure 19:
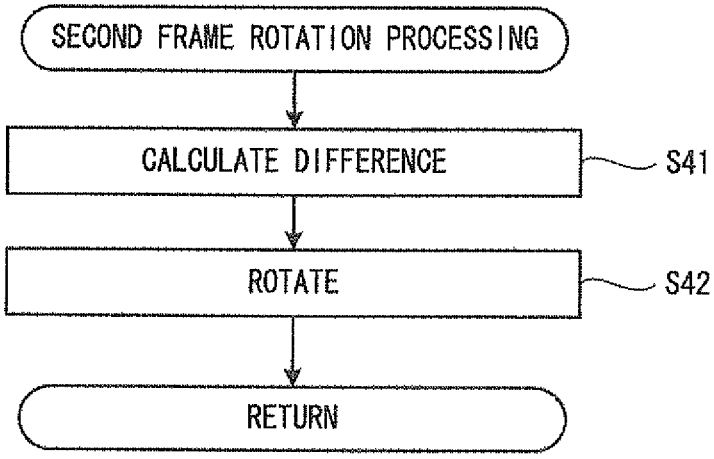
FIG. 19 is a flowchart of second frame rotation processing.

Second frame rotation processing shown in FIG. 19 may be performed in place of the first frame rotation processing at step S21 of the cutwork processing (refer to FIG. 13).

In the second frame rotation processing, a difference between the rotation angle based on the frame rotation data (the target rotation angle) and the determined angle determined at step S13 is calculated (step S41). For example, in the case shown in the image 151 in FIG. 15, the rotation angle determined at step S13 is "+45 degrees." The rotation angle based on the frame rotation data (the target rotation angle) when the variable N is "1" is "0 degrees" (refer to FIG. 12). Thus, "−45 degrees" is calculated as the difference between the target rotation angle of "0 degrees" and the determined angle of "+45 degrees" determined at step S13.

The motor 947 is controlled and the middle frame 92 (the assembled unit 95) is rotated by the rotation angle that corresponds to the difference calculated at step S41 (step S42). Specifically, the motor 947 is driven such that the middle frame 92 rotates in the clockwise direction (the minus direction) by "45 degrees." In this way, from a state of the embroidery frame 9 shown in the image 151 in FIG. 15, the middle frame 92 is rotated by "−45 degrees" and the rotation angle of the middle frame 92 becomes "0 degrees", which is the same as the target rotation angle, as shown in the image 153 in FIG. 18. When the rotation of the middle frame 92 is complete, the second frame rotation processing ends and the processing from step S22 to step S26 is performed in a similar manner to the above-described embodiment (refer to FIG. 13).

As described above, in the second frame rotation processing of the modified example, the middle frame 92 is rotated by the angle that corresponds to the difference calculated at step S41 (step S42). Thus, it is possible to automatically adjust the rotation angle of the middle frame 92 with the rotation angle based on the frame rotation data.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising: a mounting adaptor configured to be mounted with an embroidery frame, the embroidery frame including:

a frame configured to hold a work cloth;

an outer frame configured to be detachable outside in a radial direction of the frame and rotatably support the frame; and a driver configured to drive rotationally the frame with respect to the outer frame;

a memory configured to store frame rotation data, the frame rotation data indicating a setting angle, the setting angle being a predetermined rotation angle of the frame with respect to the outer frame;

an imager configured to image an area including the embroidery frame mounted on the mounting adaptor; and a processor configured to control the sewing machine to:

detect a marker provided on at least one of the embroidery frame and the work cloth based on the image;

determine a rotation angle of the frame with respect to the outer frame based on the detected marker; and control the driver to adjust a rotation of the frame based on the determined rotation angle and the frame rotation data.

2. The sewing machine according to claim 1, wherein the controlling the driver comprising:

controlling the driver to adjust the rotation of the frame when the setting angle is not equal to the determined rotation angle; and controlling the driver to stop the rotation of the frame when the setting angle is equal to the determined rotation angle.

3. The sewing machine according to claim 1, wherein the controlling the driver comprising:

calculating a difference between the setting angle and the determined rotation angle; and controlling the driver to rotate the frame by a degree of angle corresponding to the calculated difference.

4. The sewing machine according to claim 1, further comprising:

a needle bar driver configured to drive a needle bar mountable with a needle, wherein the processor is further configured to control the sewing machine to:

control the needle bar driver to start driving of the needle bar when the setting angle is equal to the determined rotation angle.

5. The sewing machine according to claim 1, further comprising:

a sewing machine side connector configured to electrically connect to a frame side connector provided on the embroidery frame, wherein the sewing machine side connector is configured to be coupled with the frame side connector when the embroidery frame is mounted on the mounting adaptor, and wherein the processor is configured to electrically connect to the driver via the sewing machine side connector and the frame side connector.

6. The sewing machine according to claim 1, wherein the frame of the embroidery frame includes:

an inner frame having a circular shape; and a middle frame configured to be detachably mounted to an outside of the inner frame in a radial direction of the inner frame, an inner radius of the middle frame being larger than an outer radius of the inner frame, and wherein the outer frame is configured to be detachably mounted to an outside of the middle frame in a radial direction of the middle frame and rotatably support the middle frame, the outer frame has a circular shape, and an inner radius of the outer frame is larger than an outer radius of the middle frame.

7. An embroidery frame comprising:

a frame configured to hold a work cloth;

an outer frame configured to be detachable outside in a radial direction of the frame and rotatably support the frame; and a driver configured to drive rotationally the frame with respect to the outer frame.

8. The embroidery frame according to claim 7, wherein the frame comprises:

an inner frame having a circular shape; and a middle frame configured to be detachably mounted to an outside of the inner frame in a radial direction of the inner frame, an inner radius of the middle frame being larger than an outer radius of the inner frame, and wherein the outer frame is configured to be detachably mounted to an outside of the middle frame in a radial direction of the middle frame and rotatably support the middle frame, the outer frame has a circular shape, and an inner radius of the outer frame is larger than an outer radius of the middle frame.

9. The embroidery frame according to claim 8, wherein the outer frame comprises:

a support portion configured to rotatably support the middle frame, the support portion having a circular shape;

an attachment portion provided on an outer side in an radial direction of the support portion, the attachment portion being configured to be detachably mounted on a mounting adaptor disposed in a sewing machine; and a storage portion configured to house the driver inside the storage portion, the storage portion provided between the support portion and the attachment portion to join the support portion and the attachment portion.

10. The embroidery frame according to claim 9, further comprising:

a frame side connector portion configured to electrically connect to a sewing machine side connector disposed in the mounting adaptor when the attachment portion is mounted on the mounting adaptor.

11. The embroidery frame according to claim 8, wherein the middle frame comprises a first gear wheel formed on the outer frame, wherein the driver comprises:

a motor disposed on the outer frame; and a second gear wheel configured to mesh with the first gear wheel, the second gear wheel is fixed on a rotation axis of the motor, and a radius of the second gear wheel is smaller than a radius of the first gear wheel.

12. The embroidery frame according to claim 8, wherein the inner frame comprises a marker configured to be imaged by an imager disposed in a sewing machine.

* * * * *